US008789899B2

(12) United States Patent
Pirro et al.

(10) Patent No.: US 8,789,899 B2
(45) Date of Patent: Jul. 29, 2014

(54) MERCHANDISER RACK

(75) Inventors: Jeffrey P. Pirro, Marcellus, NY (US); Matthew W. Farrell, Syracuse, NY (US); Kevin C. Joyce, Evanston, IL (US); Jamie A. Zettlmeier, Arlington Heights, IL (US)

(73) Assignee: Eveready Battery Company, Inc., St. Louis, MO (US)

( * ) Notice: Subject to any disclaimer, the term of this patent is extended or adjusted under 35 U.S.C. 154(b) by 1013 days.

(21) Appl. No.: 12/019,302

(22) Filed: Jan. 24, 2008

(65) Prior Publication Data

US 2009/0188882 A1 Jul. 30, 2009

(51) Int. Cl.

| | |
|---|---|
| ***A47B 87/00*** | (2006.01) |
| ***A47F 3/00*** | (2006.01) |
| ***A47F 5/13*** | (2006.01) |
| *A47B 97/00* | (2006.01) |

(52) U.S. Cl.

CPC ..... *A47F 3/004* (2013.01); *A47F 5/137* (2013.01)

USPC ..... 312/202; 312/249.9

(58) Field of Classification Search

CPC ..... A47F 5/0087; A47F 5/0081; A47F 5/00; A47B 46/00; A47B 49/00

USPC ..... 211/189, 187, 86.01, 87.01, 106.01, 211/57.1, 59.1, 4, 54.1, 151; 312/321.5, 312/202, 249.9; 52/36.1, 64, 70, 71, 29, 32; 248/220.21, 221.11, 222.13, 222.52

See application file for complete search history.

(56) References Cited

U.S. PATENT DOCUMENTS

| | | | | |
|---|---|---|---|---|
| 241,123 | A * | 5/1881 | Danner | 312/249.2 |
| 580,383 | A * | 4/1897 | Duffee | 211/62 |
| 1,390,673 | A | 9/1921 | Crawford | |
| 1,514,055 | A | 11/1924 | Lawson | |
| 1,523,875 | A | 1/1925 | Iseman et al. | |
| 1,534,644 | A | 4/1925 | Howard | |

(Continued)

FOREIGN PATENT DOCUMENTS

| | | |
|---|---|---|
| DE | 2345934 | 3/1975 |
| DE | 4227077 | 2/1994 |

(Continued)

OTHER PUBLICATIONS

Patent Cooperation Treaty (PCT), International Search Report and Written Opinion for Application No. PCT/US2009/000288, filed Jan. 20, 2009, mailed Sep. 7, 2009, Korean Intellectual Property Office, Republic of Korea.

*Primary Examiner* — Joshua J Michener
*Assistant Examiner* — Devin Barnett
(74) *Attorney, Agent, or Firm* — Russell H. Toye, Jr.

(57) ABSTRACT

A merchandiser rack comprising a rear storage module having a storage area including at least one shelf and at least two display modules. The display modules have shelves, with at least a portion of the rear of the display modules having shelves being open to allow stocking of the shelves from the rear. The display modules are pivotally connected to the rear storage module to allow the display modules to be rotated relative to the rear storage module between an open position and a closed position. The open position allows access to the rear of the display modules. The merchandiser rack, when in the closed position, has an outside periphery, and the display modules are not accessible through the rear of the display modules from the outside periphery along any horizontal line.

16 Claims, 14 Drawing Sheets

(56) References Cited

U.S. PATENT DOCUMENTS 1,711,329 A 4/1929 Short
1,745,164 A 1/1930 Griffith
1,770,755 A * 7/1930 Kleinpell ..... 40/1
D82,090 S 9/1930 Marsh et al.
1,845,564 A 2/1932 Sherman
D86,761 S 4/1932 Brooks et al.
1,895,725 A 1/1933 Nuckols
1,896,721 A 2/1933 Richards
1,916,647 A 7/1933 Walker
1,947,195 A 2/1934 Flynn
D93,082 S 8/1934 Wright et al.
D93,083 S 8/1934 Wright et al.
2,034,116 A 3/1936 Palen
2,041,751 A 5/1936 Folsom et al.
D105,086 S 6/1937 Bradshaw et al.
2,123,290 A 7/1938 Powers
D116,577 S 9/1939 Schutz et al.
D119,508 S 1/1940 Waddell et al.
D122,163 S 8/1940 Hardy et al.
2,228,775 A 1/1941 Morgan
D132,318 S 5/1942 Schutz et al.
2,298,427 A 10/1942 Slanhoff
2,307,993 A 1/1943 Calhoun et al.
D141,761 S 7/1945 Gelinas et al.
2,392,287 A 1/1946 Mandel
D148,767 S 2/1948 Yantis et al.
D148,859 S 3/1948 Irwin et al.
2,477,761 A 8/1949 Messerschmidt
D156,544 S 12/1949 Lebow et al.
2,506,237 A 5/1950 Roach
2,571,301 A 10/1951 Slanhoff
D173,627 S 12/1954 Nichols
2,713,984 A 7/1955 Paige
2,723,766 A 11/1955 Kobs
2,801,754 A 8/1957 Dorfman
3,019,907 A 2/1962 Belejack
D193,821 S 10/1962 Jones et al.
3,078,133 A * 2/1963 Schauer ..... 312/321.5
3,085,694 A 4/1963 Jones
3,115,106 A 12/1963 Gersch
D198,611 S 7/1964 Brach et al.
3,141,555 A 7/1964 Funke et al.
3,201,883 A 8/1965 Schleisner-Meyer
3,232,442 A 2/1966 Wilson
3,285,620 A 11/1966 Mitty et al.
3,292,942 A 12/1966 Mitty et al.
3,334,952 A 8/1967 Brach
3,352,615 A 11/1967 Sandin
3,356,433 A 12/1967 Theodores
3,434,249 A * 3/1969 Richey ..... 52/1
3,438,508 A 4/1969 Kuns et al.
3,499,539 A 3/1970 Fisher
D217,517 S 5/1970 Platt et al.
3,576,259 A 4/1971 Leath
3,661,410 A 5/1972 Larson et al.
3,680,712 A 8/1972 Jurasek
3,687,091 A 8/1972 Boylan
3,873,115 A 3/1975 Shiflet
3,877,764 A 4/1975 Hillier, Jr.
D235,295 S 6/1975 Junion
D238,128 S 12/1975 Marquette et al.
4,105,126 A 8/1978 Deffner et al.
D249,273 S 9/1978 Day
4,164,287 A 8/1979 Muller et al.
4,194,313 A * 3/1980 Downing ..... 40/610
D256,199 S 8/1980 Burke et al.
4,223,500 A 9/1980 Clark et al.
4,228,903 A 10/1980 Eckert
D259,161 S 5/1981 Thauer
4,270,661 A 6/1981 Rosenband
4,299,327 A 11/1981 Thauer
4,368,804 A 1/1983 Cole
4,369,887 A 1/1983 Emery
4,416,380 A 11/1983 Flum
4,433,881 A 2/1984 Written et al.
4,444,322 A 4/1984 Lee
4,478,467 A * 10/1984 Tyndall ..... 312/249.9
4,506,790 A 3/1985 Muscari
4,519,319 A 5/1985 Howlett
D280,790 S 10/1985 Kooy
4,574,863 A 3/1986 Coleman et al.
4,583,619 A 4/1986 Fry
4,605,130 A 8/1986 Taub
D285,852 S 9/1986 Clark
D287,319 S 12/1986 Ugalde
4,627,542 A 12/1986 Fredrickson
D289,838 S 5/1987 Taub
4,705,175 A 11/1987 Howard et al.
4,753,341 A 6/1988 McIntyre
D296,630 S 7/1988 Renold et al.
D297,084 S 8/1988 Silver
4,762,235 A 8/1988 Howard et al.
4,785,945 A 11/1988 Rowse et al.
4,801,023 A 1/1989 Ecclestone
D300,072 S 2/1989 Price et al.
4,844,565 A 7/1989 Brafford et al.
D305,710 S 1/1990 Ng et al.
D306,382 S 3/1990 Glassenberg
4,925,038 A 5/1990 Gajewski
D311,289 S 10/1990 Wilson et al.
D311,464 S 10/1990 Prendergast
D311,465 S 10/1990 Prendergast
D311,467 S 10/1990 Prendergast et al.
D312,717 S 12/1990 Yau Kee
4,991,804 A 2/1991 Iannucci
5,119,944 A 6/1992 Milton
5,137,340 A 8/1992 Cugley et al.
D330,301 S 10/1992 Ugalde
D335,785 S 5/1993 Winter et al.
D338,788 S 8/1993 Evans
D339,482 S * 9/1993 Naylor ..... D6/429
D344,419 S 2/1994 Stoddard
5,295,591 A 3/1994 Slater
5,299,698 A 4/1994 Gay
D349,594 S 8/1994 Bonazza
5,351,839 A 10/1994 Beeler et al.
D352,147 S 11/1994 Dyment et al.
D353,284 S 12/1994 Greenwald
5,383,562 A 1/1995 Gay
D361,454 S 8/1995 Compton et al.
5,531,517 A 7/1996 Alpen
5,558,418 A * 9/1996 Lambright et al. ..... 312/321.5
5,564,578 A 10/1996 Smith
5,588,541 A 12/1996 Goetz
5,593,048 A * 1/1997 Johnson ..... 211/59.2
5,607,068 A 3/1997 Coretti, Jr. et al.
5,649,631 A * 7/1997 Loflin ..... 211/44
5,697,505 A 12/1997 Sprague
D389,656 S 1/1998 Connor et al.
5,711,438 A 1/1998 Smith
D391,420 S 3/1998 Connor et al.
5,732,834 A 3/1998 Wells
D394,966 S 6/1998 Connor et al.
D395,769 S 7/1998 Reeves
D398,460 S 9/1998 Gerstner
D400,030 S 10/1998 Wetzel
5,836,455 A 11/1998 Connor et al.
5,842,425 A * 12/1998 van der Aa ..... 108/64
5,848,798 A 12/1998 Halvorson, Jr. et al.
D403,537 S 1/1999 Connor et al.
D406,707 S 3/1999 Battaglia
D419,338 S 1/2000 Battaglia
6,033,046 A * 3/2000 Lambright ..... 312/321.5
6,048,044 A * 4/2000 Biggel et al. ..... 312/258
6,053,588 A * 4/2000 Biggel et al. ..... 312/249.8
D425,332 S 5/2000 Buchanan et al.
6,079,754 A 6/2000 Alexy
6,099,096 A * 8/2000 Lambright ..... 312/321.5
6,105,796 A 8/2000 Buchanan et al.
D436,266 S 1/2001 Buchanan et al.
D436,787 S 1/2001 London
6,170,678 B1 1/2001 de la Fuente
D438,399 S 3/2001 Caloia et al.
6,267,253 B1 7/2001 Jellicorse et al.

(56) References Cited

U.S. PATENT DOCUMENTS

| | | | | |
|---|---|---|---|---|
| D450,483 | S | 11/2001 | Chang et al. | |
| D450,485 | S | 11/2001 | Buchanan et al. | |
| D451,305 | S | 12/2001 | Chang et al. | |
| D451,707 | S | 12/2001 | Chang et al. | |
| 6,328,170 | B1 | 12/2001 | Lee | |
| 6,375,285 | B1 * | 4/2002 | Choi | 312/202 |
| D457,751 | S | 5/2002 | Stafford et al. | |
| 6,422,668 | B1 * | 7/2002 | Kelley et al. | 312/195 |
| 6,427,857 | B1 | 8/2002 | Adams et al. | |
| 6,443,542 | B1 | 9/2002 | Lindquist et al. | |
| 6,467,856 | B1 | 10/2002 | Chang et al. | |
| 6,561,365 | B2 * | 5/2003 | Bustos | 211/187 |
| 6,578,938 | B2 * | 6/2003 | Norman et al. | 312/290 |
| 6,595,609 | B1 * | 7/2003 | Greiner | 312/321.5 |
| 6,659,294 | B1 | 12/2003 | Simard | |
| D486,324 | S | 2/2004 | Mason | |
| 6,692,092 | B1 * | 2/2004 | Evans | 312/311 |
| 6,739,096 | B2 * | 5/2004 | Feldpausch et al. | 52/36.1 |
| 6,752,281 | B1 | 6/2004 | Mason et al. | |
| D496,193 | S | 9/2004 | Mason | |
| 6,871,922 | B1 * | 3/2005 | Pustilnikov | 312/351.14 |
| 6,877,618 | B2 | 4/2005 | Mason | |
| 6,926,375 | B2 | 8/2005 | Nagamine et al. | |
| 6,955,410 | B1 | 10/2005 | Nelson et al. | |
| D511,426 | S | 11/2005 | Mason | |
| 6,996,939 | B1 * | 2/2006 | Jackson | 52/36.4 |
| 7,044,178 | B1 * | 5/2006 | Campbell | 144/285 |
| 7,147,291 | B1 * | 12/2006 | Greiner | 312/294 |
| 7,182,416 | B1 * | 2/2007 | Greiner | 312/321.5 |
| 7,261,384 | B1 * | 8/2007 | Craft et al. | 312/235.3 |
| 7,490,914 | B2 * | 2/2009 | Greiner | 312/321.5 |
| 7,562,949 | B1 * | 7/2009 | Nielsen | 312/7.2 |
| 7,963,621 | B1 * | 6/2011 | Ellis | 312/242 |
| 2002/0130098 | A1 | 9/2002 | Simard | |
| 2003/0160011 | A1 | 8/2003 | Langtry | |
| 2003/0164663 | A1 | 9/2003 | Chang et al. | |
| 2004/0020878 | A1 | 2/2004 | Boron | |
| 2004/0195195 | A1 | 10/2004 | Mason | |
| 2004/0262246 | A1 | 12/2004 | Martins | |
| 2005/0161416 | A1 | 7/2005 | Anderson | |

FOREIGN PATENT DOCUMENTS

| | | | |
|---|---|---|---|
| GB | 249311 | | 3/1925 |
| JP | 2005-253719 | A | 9/2005 |
| JP | 2006-034892 | A | 2/2006 |
| KR | 20-0286876 | Y1 | 8/2002 |
| WO | WO9419642 | | 9/1994 |

* cited by examiner

MERCHANDISER RACK

FIELD OF THE INVENTION

The present invention relates to merchandisers, and in particular to a four-way island merchandiser.

BACKGROUND OF THE INVENTION

Shelving units are used in stores to display merchandise or stock sold in the stores. The shelving units include a plurality of horizontally arranged shelves having the merchandise or stock thereon. Heretofore, once the merchandise or stock was taken from the front of the shelves, a person working at the store would have to move all of the merchandise or stock on the shelves forward to make the merchandise or stock available to a consumer and to provide an aesthetically pleasing appearance. Alternatively, the person working at the store could place more stock or merchandise on the shelves to replace the stock or merchandise taken by the consumer.

Any improvement to the stocking system that easily moves merchandise forward and makes restocking easy is desired.

SUMMARY OF THE INVENTION

One aspect of the present invention is to provide a merchandiser rack comprising a rear storage module having a storage area including at least one shelf for storing products and at least two display modules. The display modules each have a front and a rear. At least one of the display modules has shelves, with at least a portion of the rear of the at least one of the display modules having shelves being open to allow stocking of the shelves from the rear. The shelves are also accessible from the front of the at least one of the display modules having shelves. The display modules are pivotally connected to the rear storage module to allow the display modules to be rotated relative to the rear storage module between an open position and a closed position. The open position allows access to the rear of the at least one of the display modules having shelves and having the at least a portion of the rear that is open to be stocked from the rear. The merchandiser rack, when in the closed position, has an outside periphery, and the display modules are not accessible through the rear of the display modules from the outside periphery along any horizontal line.

Another aspect of the present invention is to provide a merchandiser rack comprising a substantially rectangular rear storage module and two substantially rectangular display modules. The rear storage module has a storage area including at least one shelf for storing products. The rear storage module has a storage front and a storage rear. The rear storage module has a front first side corner and a front second side corner. Each of the display modules each has a display front and a stocking rear. The display modules have shelves, with at least a portion of the rear of the display modules being open to allow stocking of the shelves from the stocking rear. The shelves are also accessible from the display front of the display modules. A first one of the rectangular display modules is pivotally connected with the front first side corner of the rear storage module. A second one of the rectangular display modules is pivotally connected with the front second side corner of the rear storage module. The display modules are pivotally connected to the rear storage module to allow the display modules to be rotated relative to the rear storage module between an open position wherein the stocking rear of the display modules are accessible and a closed position wherein the stocking rear of the display modules is adjacent the storage rear of the rear storage module. The open position allows access to the stocking rear of the display modules to allow the display modules to be stocked from the stocking rear. The merchandiser rack, when in the closed position, has an outside periphery, and the display modules are not accessible through the stocking rear of the display modules from the outside periphery along any horizontal line.

Yet another aspect of the present invention is to provide a method of supplying a merchandiser rack comprising providing a rear storage module having a storage area including at least one shelf for storing products and pivotally connecting at least two display modules to the rear storage module, with the display modules each having a front, a rear and shelves. At least a portion of the rear of the at least one of the display modules has shelves being open. The shelves also are accessible from the front of the at least one of the display modules having shelves. The method also includes pivotally connecting the display modules to the rear storage module, rotating the display modules relative to the rear storage module from a closed position to an open position and stocking the shelves from the rear, and rotating the display modules relative to the rear storage module back to the closed position. The merchandiser rack, when in the closed position, has an outside periphery, and the display modules are not accessible through the rear of the display modules from the outside periphery along any horizontal line.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
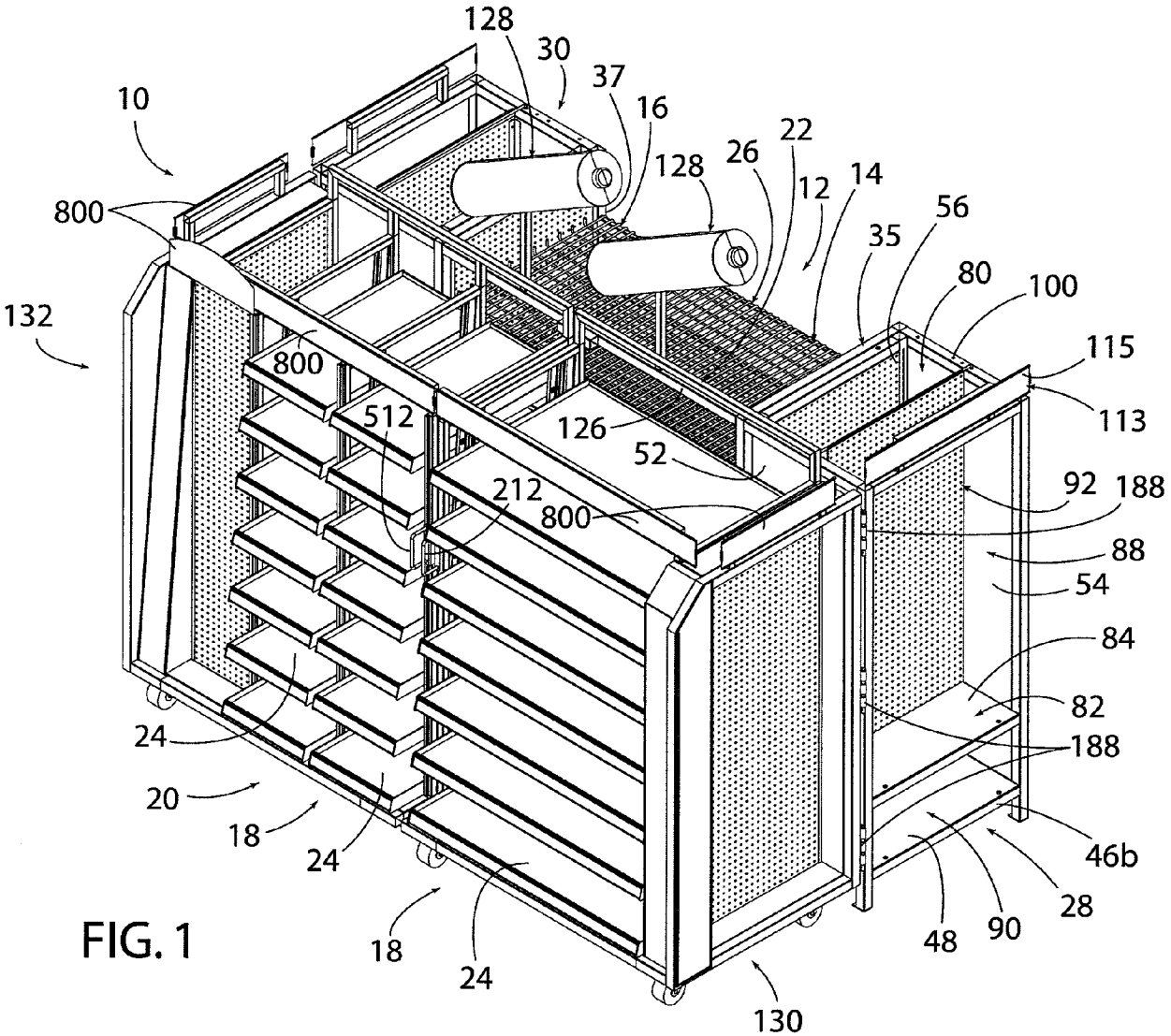
FIG. 1 is a perspective view of a merchandiser rack of the present invention in a closed position.
Figure 2:
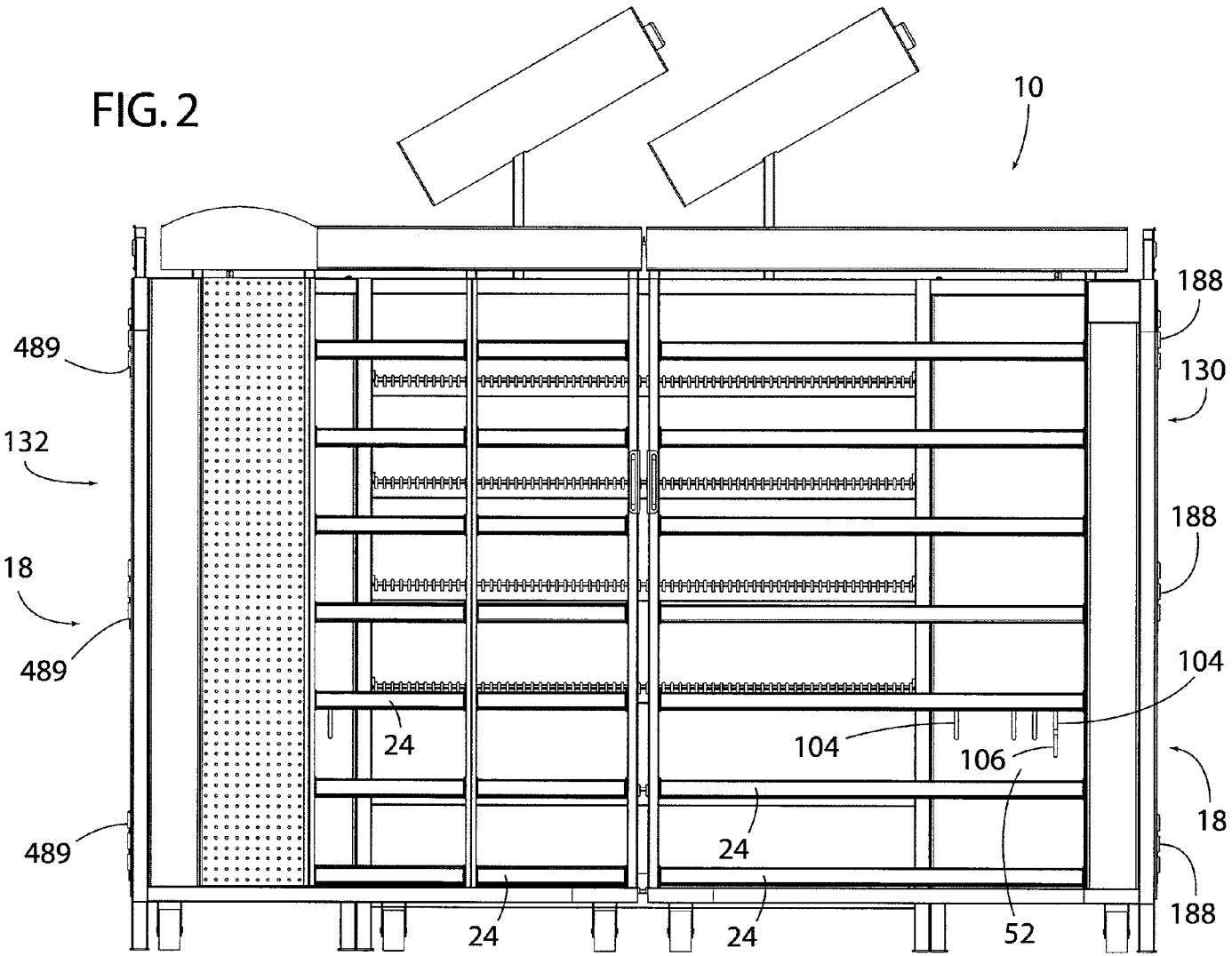
FIG. 2 is a front view of the merchandiser rack of the present invention in a closed position.
Figure 3:
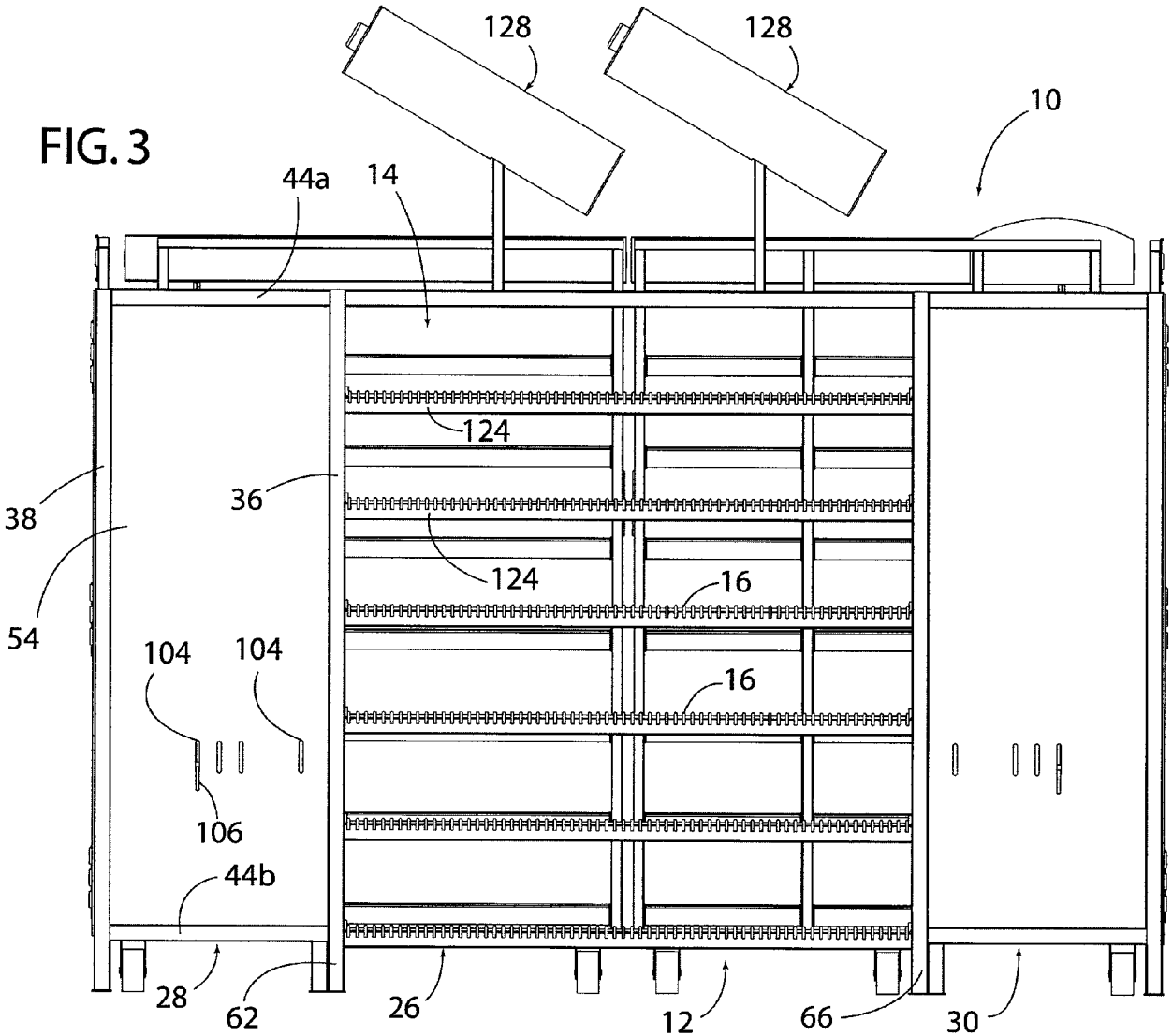
FIG. 3 is a rear view of the merchandiser rack of the present invention in a closed position.
Figure 4:
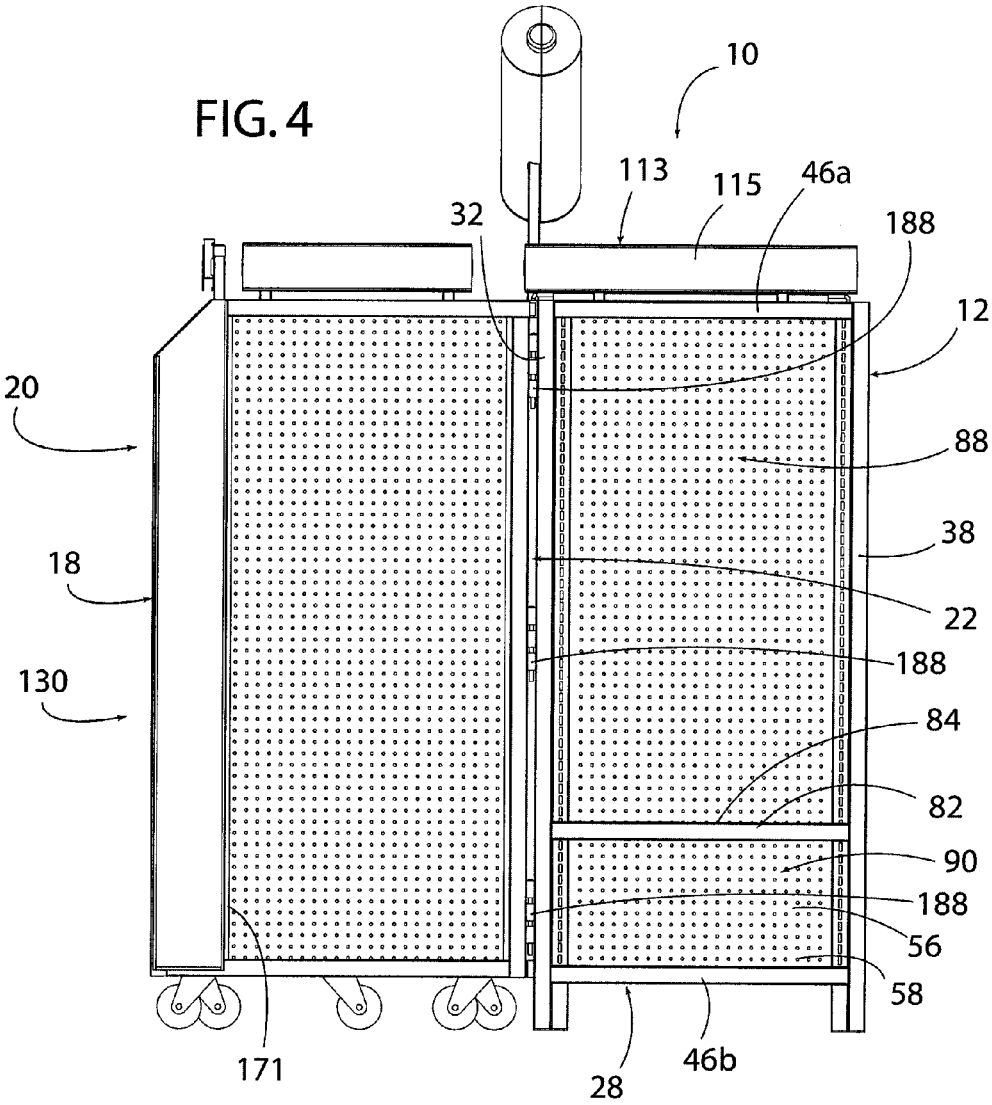
FIG. 4 is a right side view of the merchandiser rack of the present invention in a closed position.
Figure 5:
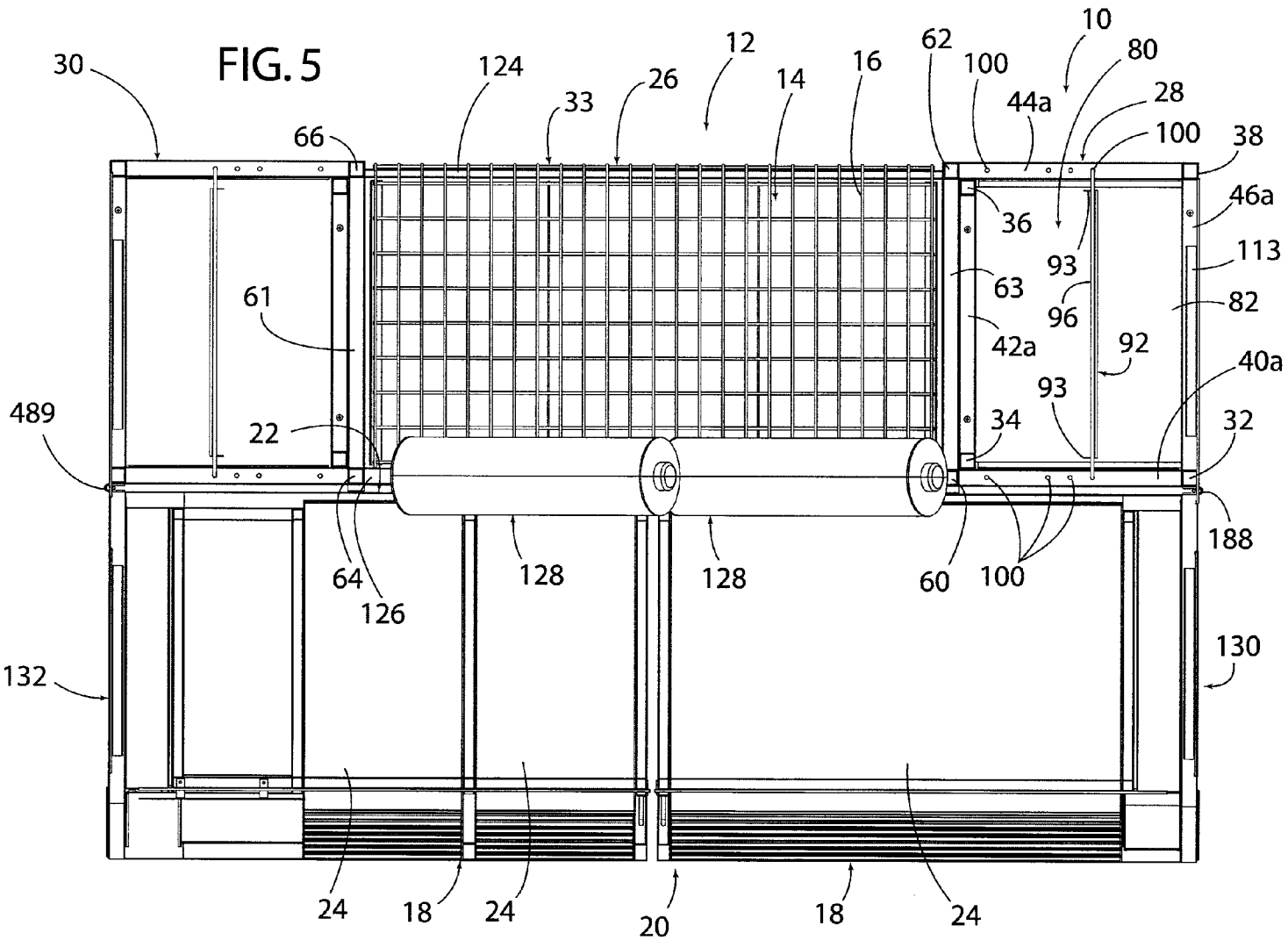
FIG. 5 is a top view of the merchandiser rack of the present invention in a closed position.
Figure 6:
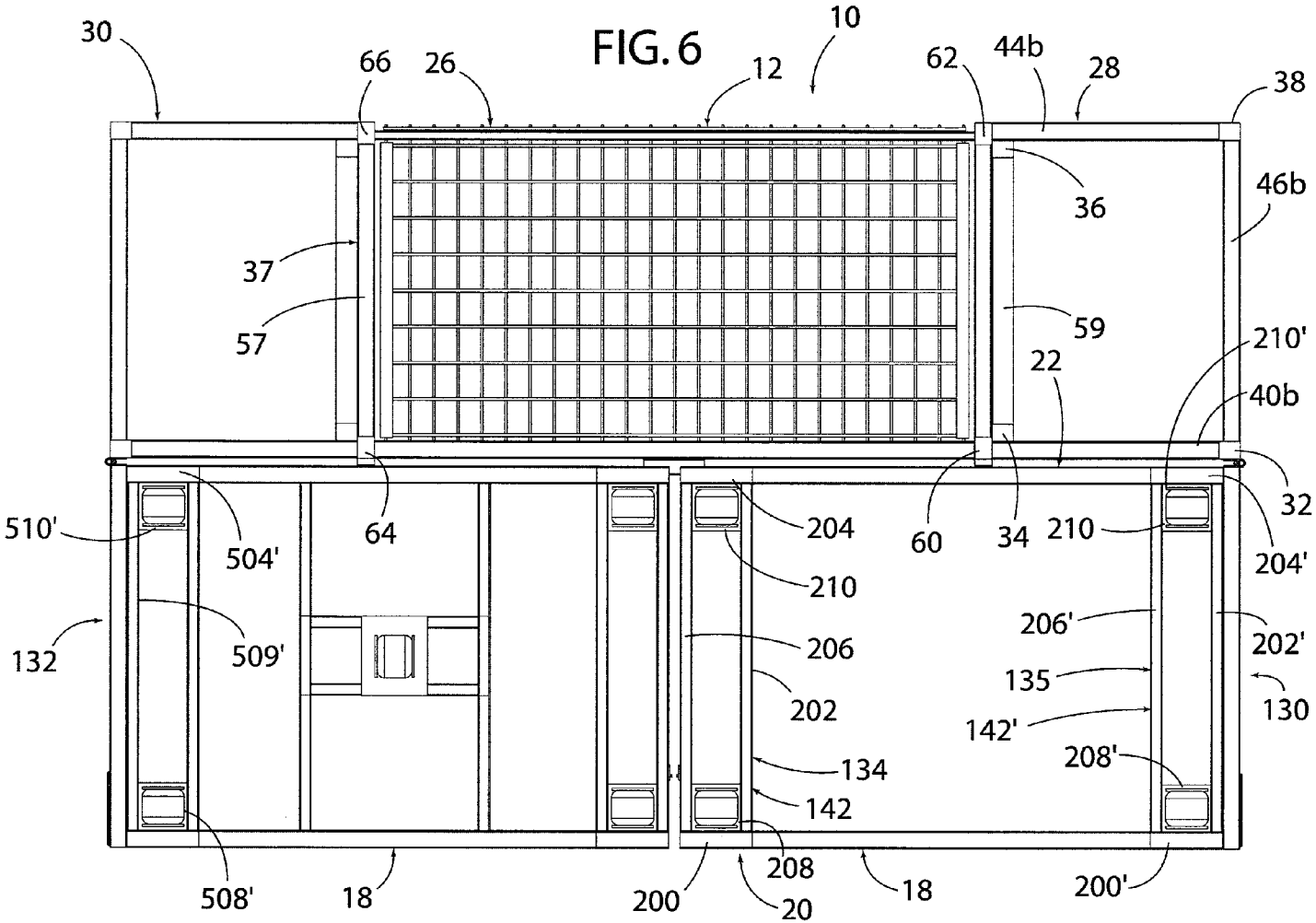
FIG. 6 is a bottom view of the merchandiser rack of the present invention in a closed position.

For purposes of description herein, the terms "upper," "lower," "right," "left," "rear," "front," "vertical," "horizontal," and derivatives thereof shall relate to the invention as orientated in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-9) generally designates a merchandiser rack of the present invention. The merchandiser rack 10 comprises a rear storage module 12 and at least two display modules 18. The rear storage module 12 has a storage area 14 including at least one storage shelf 16 for storing products. The display modules 18 each have a front 20 and a rear 22. At least one of the display modules 18 has display shelves 24, with at least a portion of the rear 22 of the at least one of the display modules 18 having display shelves 24 being open to allow stocking of the display shelves 24 from the rear 22. The display shelves 24 are also accessible from the front 20 of the at least one of the display modules 18 having display shelves 24. The display modules 18 are pivotally connected to the rear storage module 12 to allow the display modules 18 to be rotated relative to the rear storage module 12 between an open position (see FIGS. 7-9) and a closed position (see FIGS. 1-6). The open position allows access to the rear 22 of the at least one of the display modules 18 having display shelves 24 and having the at least a portion of the rear 22 that is open to be stocked from the rear 22. The merchandiser rack 10, when in the closed position, has an outside periphery, and the display modules 18 are not accessible through the rear 22 of the display modules 18 from the outside periphery along any horizontal line.

In the illustrated example, the rear storage module 12 includes the storage area 14 for storing products. The rear storage module 12 is illustrated having a substantially rectangular periphery. However, it is contemplated that the rear storage module 12 could have other geometric configurations. For example, the rear storage module 12 could have a triangular periphery. The illustrated rear storage module 12 includes a center storage section 26 defining the storage area 14, a right side display section 28 and a left side display section 30. The center storage section 26 is located between and connected to the right side display section 28 and the left side display section 30. While the rear storage module 12 is illustrated as including the right side display section 28 and the left side display section 30 with the display modules 18 pivotally connected to the right side display section 28 and the left side display section 30, it is contemplated that the rear storage module 12 could include only the center storage section 26 with the display modules 18 pivotally connected to the center storage section 26 or only one of the right side display section 28 and the left side display section 30 could be used with the display modules 18 pivotally connected to the center storage section 26 and the one of the right side display section 28 and the left side display section 30 used in this embodiment (with it being noted that the center storage section 26 is no longer in the "center," but to the side of the right side display section 28 or the left side display section 30).

The illustrated right side display section 28 and the left side display section 30 are substantially mirror images of each other and are used to display and/or store products for sale. Accordingly, only the right side display section 28 will be discussed, with the left side display section 30 being a mirror image of the right side display section 28. However, it is contemplated that the right side display section 28 and the left side display section 30 could have different configurations. The illustrated right side display section 28 (see FIGS. 1, 3-6 and 10) has a substantially horizontal and rectangular peripheral configuration. The right side display section 28 includes a front/right side post 32, a front/left side post 34, a rear/left side post 36 and a rear/right side post 38. The posts 32, 34, 36 and 38 can include a support plate 31, a pad or other friction surface on a bottom thereof to prevent the right side display section 28 from easily moving. It is contemplated that the front/right side post 32, the front/left side post 34, the rear/left side post 36 and the rear/right side post 38 could include caps 103 inserted into a top thereof for aesthetic purposes. A top/front side bar 40*a* is connected to and between the front/right side post 32 and the front/left side post 34, a top/left side bar 42*a* is connected to and between the front/left side post 34 and the rear/left side post 36, a top/rear side bar 44*a* is connected to and between the rear/left side post 36 and the rear/right side post 38, and a top/right side bar 46*a* is connected to and between the rear/right side post 38 and the front/right side post 32. A bottom/front side bar 40*b* is connected to and between the front/right side post 32 and the front/left side post 34, a bottom/left side bar 42*b* is connected to and between the front/left side post 34 and the rear/left side post 36, a bottom/rear side bar 44*b* is connected to and between the rear/left side post 36 and the rear/right side post 38, and a bottom/right side bar 46*b* is connected to and between the rear/right side post 38 and the front/right side post 32. The posts 32, 34, 36 and 38, the top side bars 40*a*, 42*a*, 44*a* and 46*a* and the bottom bars 40*b*, 42*b*, 44*b* and 46*b* are illustrated as having a substantially rectangular horizontal cross section. However, any horizontal cross section could be used. Furthermore, the posts 32, 34, 36 and 38, the top side bars 40*a*, 42*a*, 44*a* and 46*a* and the bottom side bars 40*b*, 42*b*, 44*b* and 46*b* could be made of any material (e.g., wood, metal, plastic, etc.).

In the illustrated example, a bottom shelf 48 connects to the front/right side post 32, the front/left side post 34, the rear/left side post 36 and the rear/right side post 38 adjacent bottoms thereof. The bottom shelf 48 comprises a substantially rectangular plate 50 having a left front notch 70, a left rear notch 72, a front side downwardly depending flange 71 and a rear side downwardly depending flange (not shown). The front/left side post 34 is located in the left front notch 70 and the rear/left side post 36 is located in the left rear notch 72. The bottom shelf 48 is connected to the top of the bottom/left side bar 42*b* and the bottom/right side bar 46*b*. The front side downwardly depending flange 71 of the bottom shelf 48 abuts against an inside of the bottom/front side bar 40*b* and the rear side downwardly depending flange abuts against an inside of the bottom/rear side bar 44*b*.

The illustrated right side display section 28 includes a front side wall 52 enclosing a front of the right side display section 28 between the front/right side post 32, the front/left side post 34, the top/front side bar 40*a* and the bottom shelf 48. The front side wall 52 is connected to a front side of the front/left side post 34 and a vertically extending flange (not shown) extending towards the left from the front/right side post 32 between the top/front side bar 40*a* and the bottom shelf 48. Likewise, a rear side wall 54 encloses a rear of the right side display section 28 between the rear/right side post 38, the rear/left side post 36, the top/rear side bar 44*a* and the bottom shelf 48. The rear side wall 54 is connected to a rear side of the rear/left side post 36 and a vertically extending flange 38' extending towards the left from the rear/right side post 38 between the top/rear side bar 44*a* and the bottom shelf 48.

In the illustrated example, the right side display section 28 is used to display and/or store products for sale. A first item for displaying and/or storing products for sale of the right side display section 28 comprises the bottom shelf 48. A second item for displaying and/or storing products for said of the right side display section 28 comprises a main pegboard 56 having a plurality of openings 58. The main pegboard 56 is located at the left side of the right side display section 28 and is connected to the front/left side post 34 and the rear/left side post 36. The main pegboard 56 is connected to a first vertically extending flange 34' extending towards the rear from the front/left side post 34 between top/left side bar 42*a* and the bottom shelf 48 and a second vertically extending flange 36' extending towards the front from the rear/left side post 36 between top/left side bar 42*a* and the bottom shelf 48. The main pegboard 56 is configured to accept hanger rods (not shown) inserted into the openings 58. The hanger rods can accept products thereon for displaying the products as is well known to those skilled in the art. The front side wall 52, the rear side wall 54, the main pegboard 56 and the bottom shelf 48 define an open space 80 (see FIG. 1) within right side display section 28 accessible from the right side of the rear storage module 12.

A third item for displaying and/or storing products for sale of the right side display section 28 comprises at least one movable shelf 82 (not shown in FIG. 10) for supporting products thereon located in the open space 80 of the right side display section 28. The at least one movable shelf 82 comprises a substantially rectangular plate 84 connected to the front/left side post 34 and the rear/left side post 36. The front/left side post 34 and the rear/left side post 36 each include a plurality of vertically spaced slots 86 on a face thereof facing the right side of the right side display section 28. The at least one movable shelf 82 has at least two hooks (not shown) at a left side thereof configured to be selectively inserted into the vertically spaced slots 86 at a selected vertical position in the open space 80 to divide the open space 80 into at least one upper mini-space 88 and at least one lower mini-space 90. The lower mini-space 90 is located between the bottom of the at least one movable shelf 82 and a top of the bottom shelf 48. Products can be placed into the lower mini-space 90 for display or storage. Although only one movable shelf 82 is shown, any number of movable shelves 82 could be positioned in the open space 80. Products can be placed on any of the movable shelves 82 for display or storage. The posts, top bars, bottom bars, and top pegboard bars are illustrated as having a substantially rectangular horizontal cross section. However, any horizontal cross section could be used. Furthermore, the posts, top bars, bottom bars, and top pegboard bars could be made of any material (e.g., wood, metal, plastic, etc.).

A fourth item for displaying and/or storing products for sale of the right side display section 28 comprises a divider peg board 92 positioned in the open space 80. While the divider peg board 92 is illustrated as being in the upper mini-space 88, it is contemplated that the divider peg board 92 could be located in the entire open space 80. The divider peg board 92 includes a plurality of openings 94 configured to accept hanger rods (not shown) inserted into the openings 94, with the hanger rods accepting products thereon for displaying the products. The hanger rods can accept products thereon for displaying the products as is well known to those skilled in the art. The divider peg board 92 includes a pair of side L-shaped flanges 93 for providing support for the divider peg board 92. A top inverted U-shaped hook rod 96 is connected to the top of the divider peg board 92 and the L-shaped flanges 93 and a bottom inverted U-shaped hook rod 98 is connected to the bottom of the divider peg board 92 and the L-shaped flanges 93.

In the illustrated example, the top inverted U-shaped hook rod 96 and the bottom inverted U-shaped hook rod 98 connect the divider peg board 92 to the right side display section 28. The top/front side bar 40*a* and the top/rear side bar 44*a* each include aligned pairs of openings 100 in a top thereof. Downwardly depending ends 102 of the top inverted U-shaped hook rod 96 are configured to be inserted into aligned pairs of the openings 100 to support the top of the divider peg board 92. While four openings 100 are illustrated in each of the top of the top/front side bar 40*a* and the top/rear side bar 44*a*, any number of pairs of openings 100 in any location can be made in the top/front side bar 40*a* and the top/rear side bar 44*a*. The front side wall 52 and the rear side wall 54 include aligned pairs of slots 104 therethrough. The slots 104 are substantially aligned with the openings 100 in the top of the top/front side bar 40*a* and the top/rear side bar 44*a*. Downwardly depending ends 106 of the bottom inverted U-shaped hook rod 98 are configured to be inserted into aligned pairs of the slots 104 to support the bottom of the divider peg board 92. Like the openings 100, while there are four slots 104 illustrated in the front side wall 52 and the rear side wall 54, any number of pairs of slots 104 in any location can be made in the front side wall 52 and the rear side wall 54. The divider peg board 92 divides the upper mini-space 88 into a front upper space 107 and a rear upper space 108. The divider peg board 92 can be moved forward or rearward to accommodate any length of hanger rods such that fronts of the hanger rods are positioned near the right side of the right side display section 28. It is contemplated that the divider peg board 92 can be made of any material (e.g., wood, metal, plastic, etc.).

While the right side display section 28 and the left side display section 30 are illustrated as being substantially mirror images of each other, it is contemplated that they could have different configurations. For example, either or both of the right side display section 28 and the left side display section 30 could have no movable shelves 82, any number of movable shelves 82, a divider peg board 92 in any position, or no divider peg board 92. Furthermore, either or both of the right side display section 28 and the left side display section 30 could have any configuration for storage or display of products. Moreover, either or both of the right side display section 28 and the left side display section 30 could have a display sign 113 connected to the top/right side bar 46*a*, with the display sign 113 slidably receiving a merchandise card 115 (showing name of products, cost of products, etc.) therein as is well known to those skilled in the art. It is further contemplated that the display sign 113 could be connected to any portion of either or both of the right side display section 28 and the left side display section 30.

In the illustrated example, the center storage section 26 (see FIGS. 1, 3-9 and 11) is located between and connected to the right side display section 28 and the left side display section 30. The center storage section 26 includes the plurality of storage shelves 16 for storing products for later display and sale. The center storage section 26 includes a front frame member 29, a rear frame member 33, a right side frame member 35 and a left side frame member 37. The front frame member 29 comprises a right post 60 and a left post 64. A plurality of front horizontal support bars 122 extend between the right post 60 and the left post 64. The rear frame member 33 comprises a right post 62 and a left post 66. A plurality of rear horizontal support bars 124 extend between the right post 62 and the left post 66. The right side frame member 35 is substantially rectangular and includes a front column 55, a rear column 69, a top bar 63 and a bottom bar 59. The left side frame member 37 is also substantially rectangular and includes a front column 65, a rear column 67, a top bar 61 and a bottom bar 57. The right side frame member 35 is connected to and extends between the right post 60 of the front frame member 29 and the right post 62 of the rear frame member 33. The left side frame member 37 is connected to and extends between the left post 64 of the front frame member 29 and the left post 66 of the rear frame member 33. It is contemplated that the posts 60, 62, 64 and 66 could include caps 103 inserted into a top thereof for aesthetic purposes. Furthermore, the posts 32, 34, 36 and 38 can include a support plate 31', a pad or other friction surface on a bottom thereof to prevent the center storage section 26 from easily moving.

Figure 11:
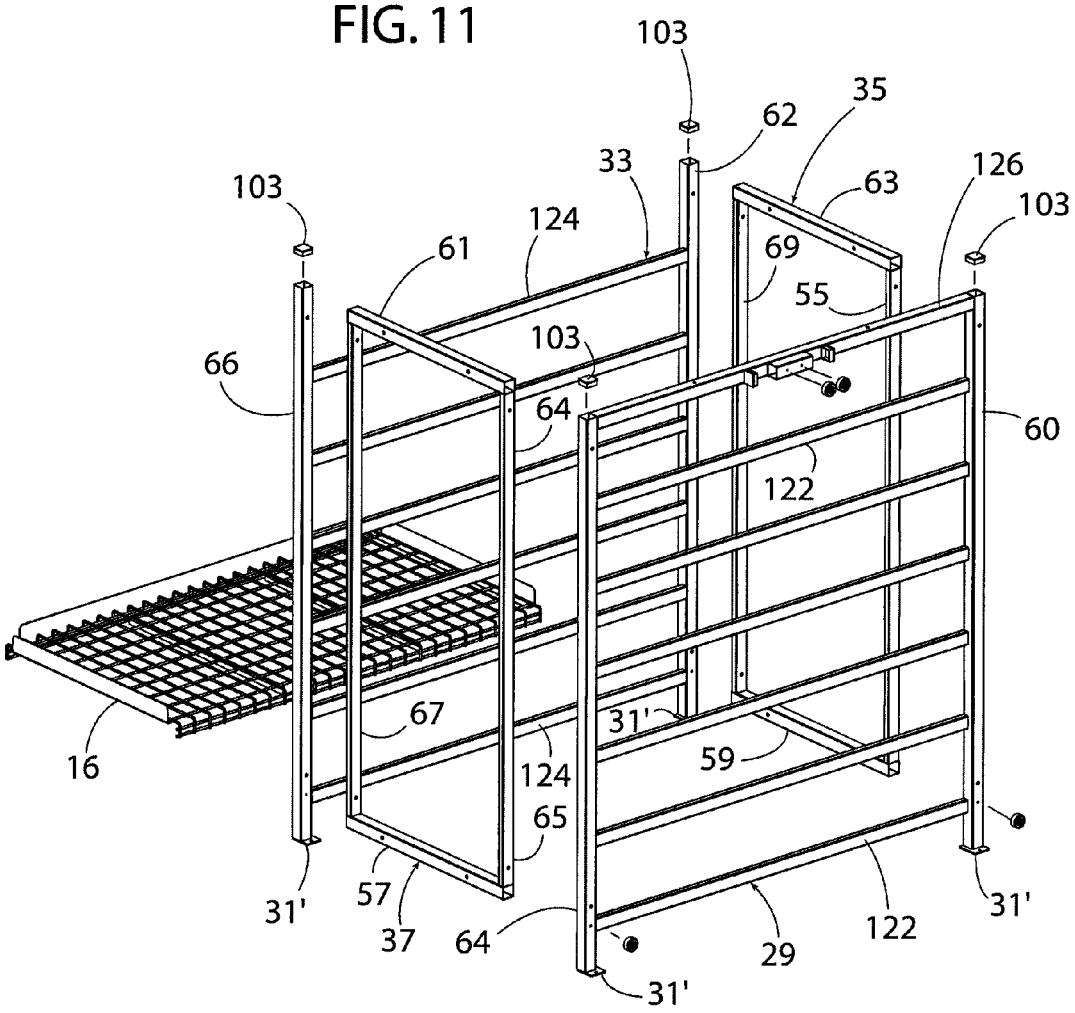
FIG. 11 is an exploded view of a center storage section of the merchandiser rack of the present invention.
Figure 12:
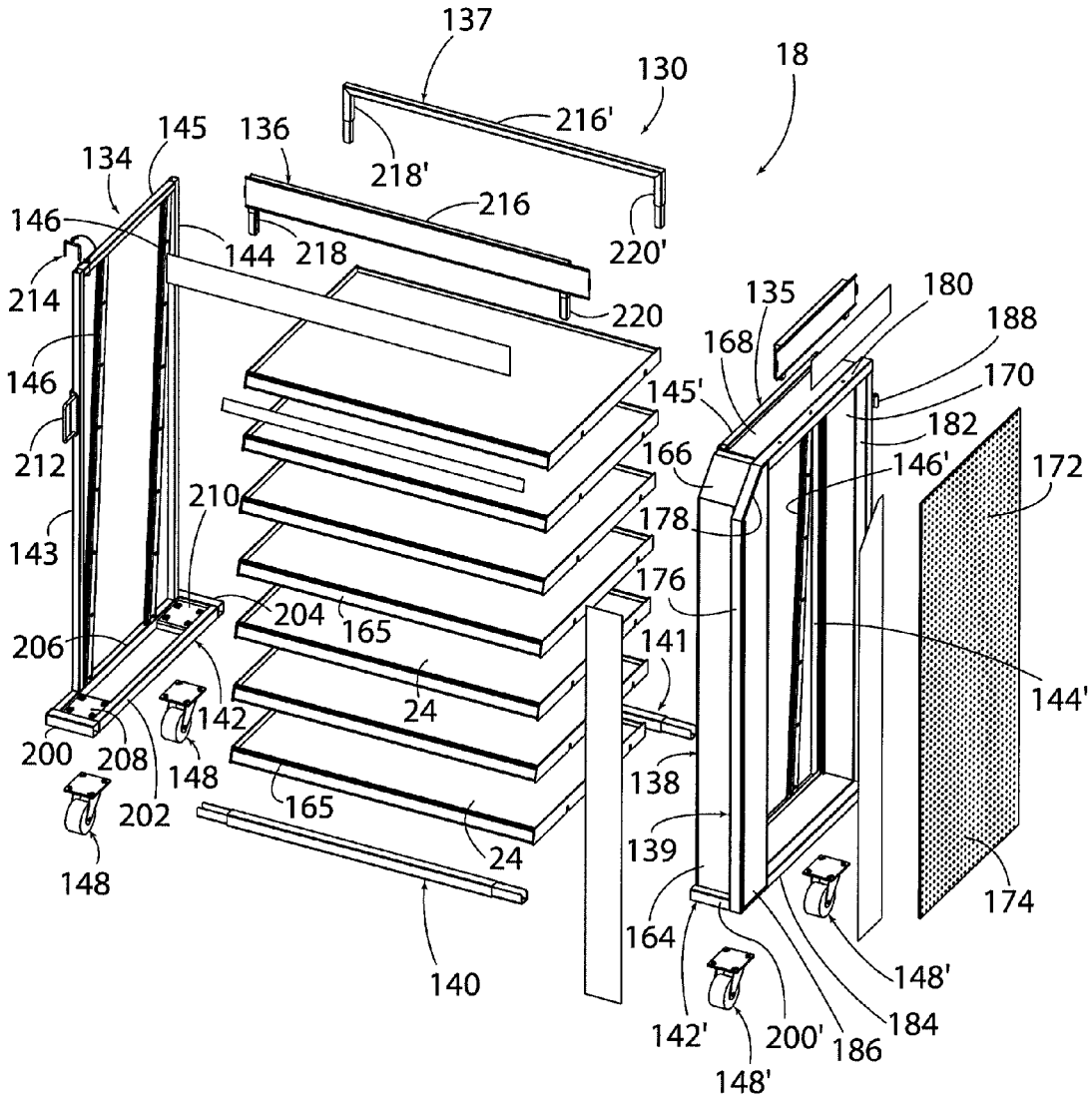
FIG. 12 is an exploded view of a right side display module of the merchandiser rack of the present invention.

The illustrated front horizontal support bars 122 and the rear horizontal support bars 124 are substantially vertically aligned and have the storage shelves 16 thereon (only one storage shelf 16 is illustrated in FIG. 11, it being understood that the center storage section 26 could include any number of storage shelves 16). Each storage shelf 16 rests on and connects to a vertically aligned pair of the front horizontal support bars 122 and the rear horizontal support bars 124. The storage shelves 16 allow for access to the products on the supply shelves when the merchandiser rack 10 is in the open position. In the illustrated example, the storage shelves 16 is a wire frame construction. However, it is contemplated that the storage shelves 16 could have any design and configuration (e.g., solid board shelf). The center storage section 26 also includes a top storage bar 126 extending between and connected to the top of right post 60 and the left post 64 of the front frame member 29. The top storage bar 126 can have a display for the products held in the center storage section 26 extending upwardly therefrom (e.g., a battery display 128). Furthermore, the posts 60, 62, 64 and 66 and the bars 57, 59, 61, 63, 122, 124 and 126 are illustrated as having a substantially rectangular horizontal cross section. However, any horizontal cross section could be used. Furthermore, the posts 60, 62, 64 and 66 and the bars 57, 59, 61, 63, 122, 124 and 126 could be made of any material (e.g., wood, metal, plastic, etc.).

Figure 7:
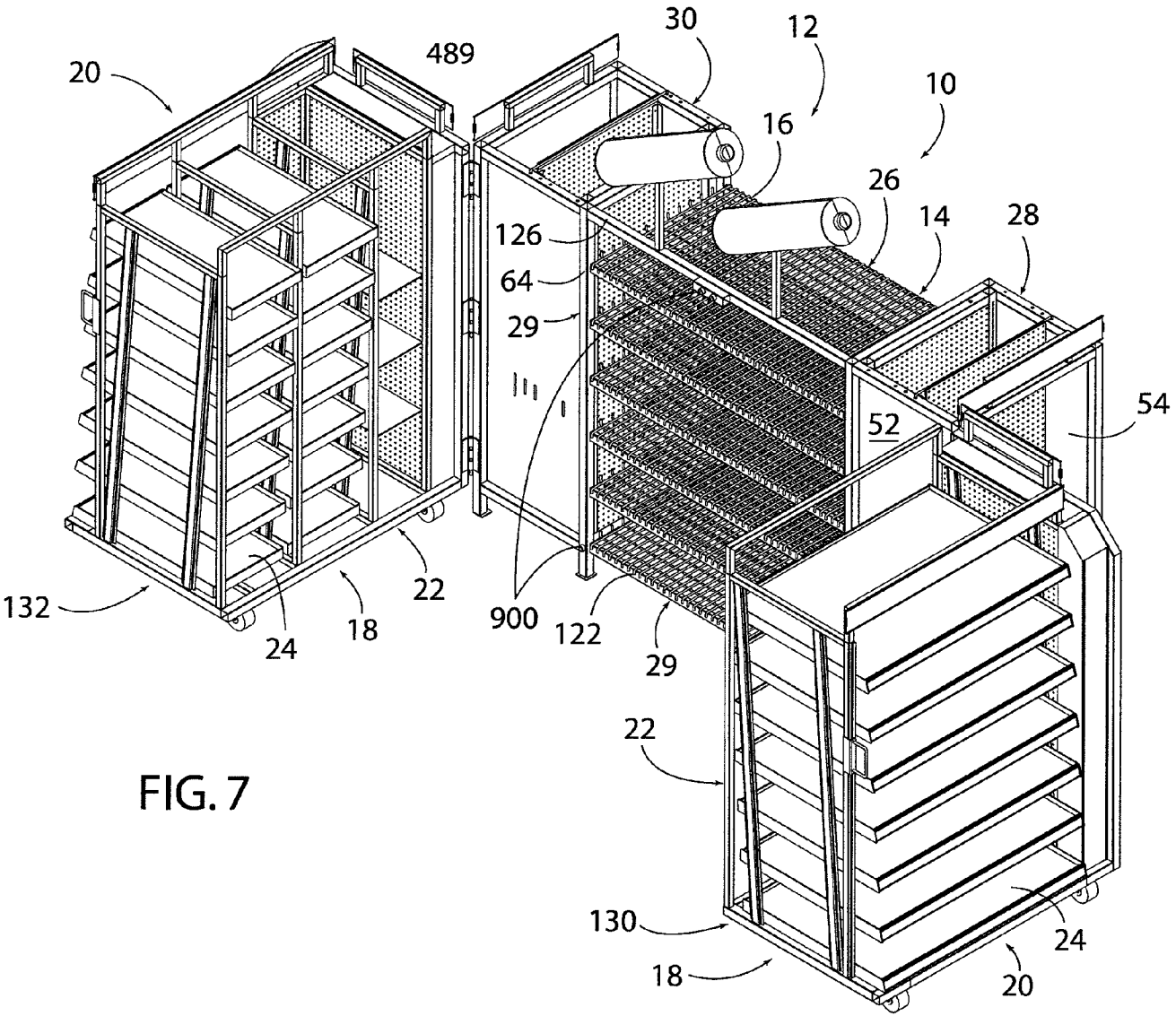
FIG. 7 is a perspective view of the merchandiser rack of the present invention in an open position.
Figure 8:
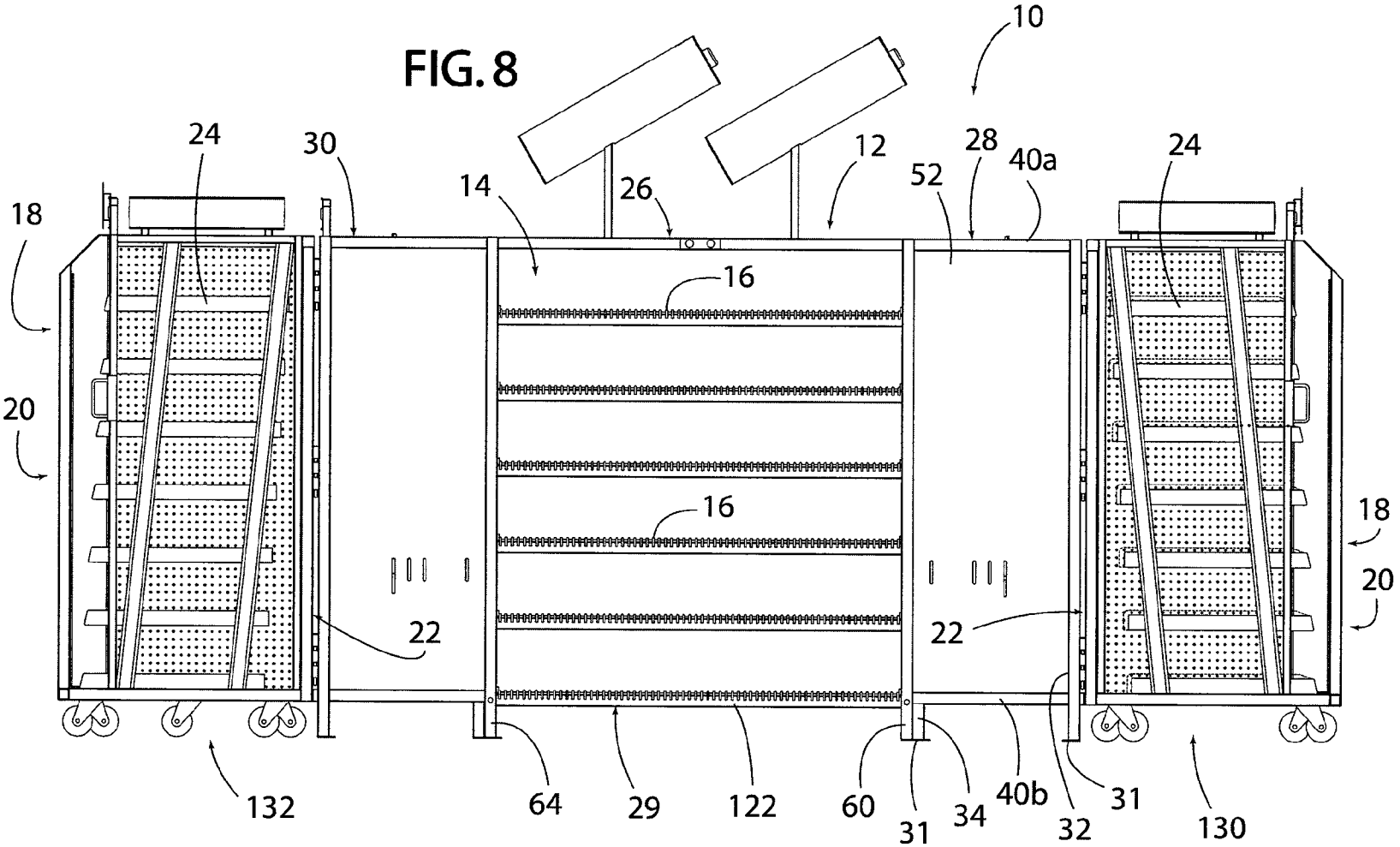
FIG. 8 is a front view of the merchandiser rack of the present invention in an open position.
Figure 9:
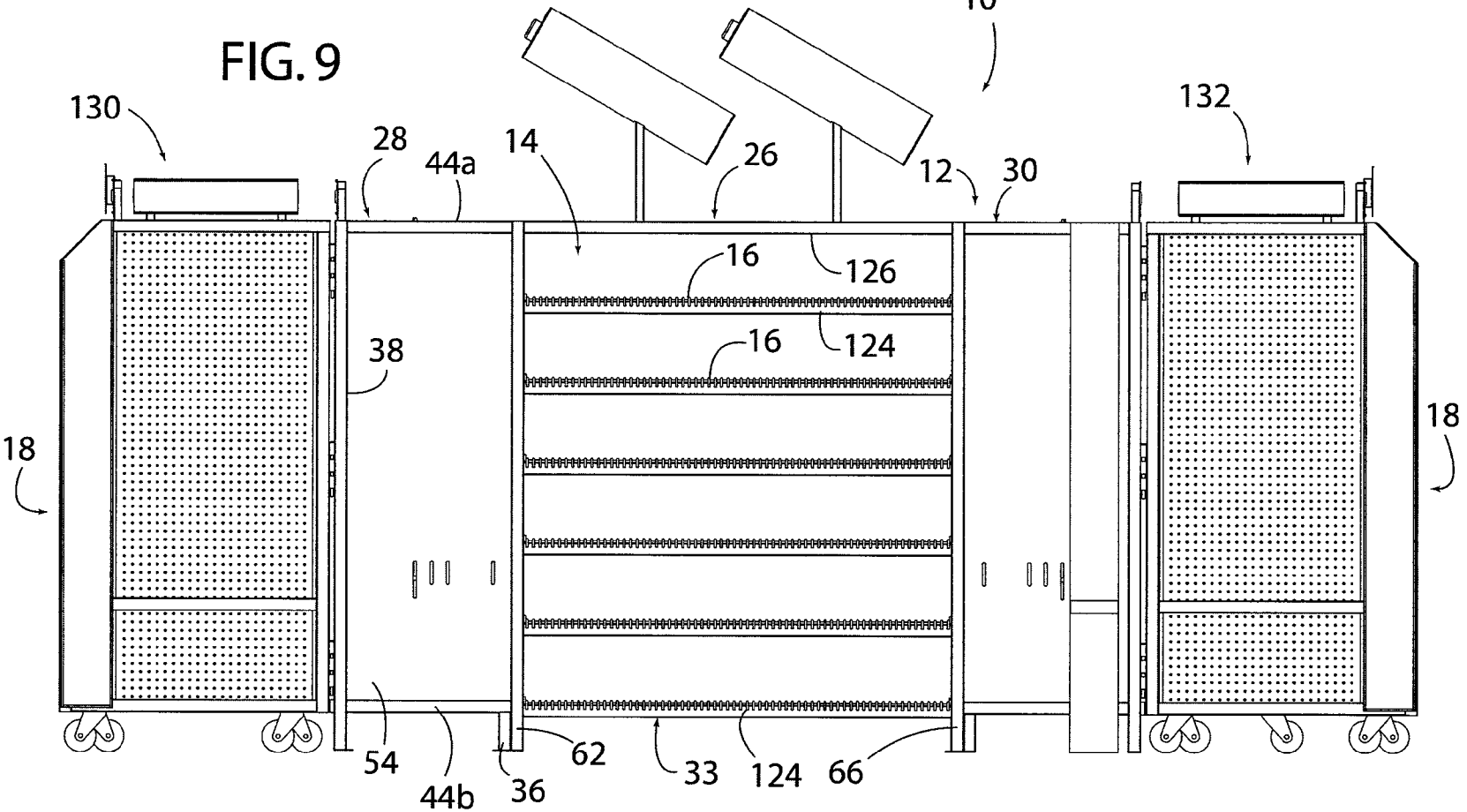
FIG. 9 is a rear view of the merchandiser rack of the present invention in an open position.
Figure 10:
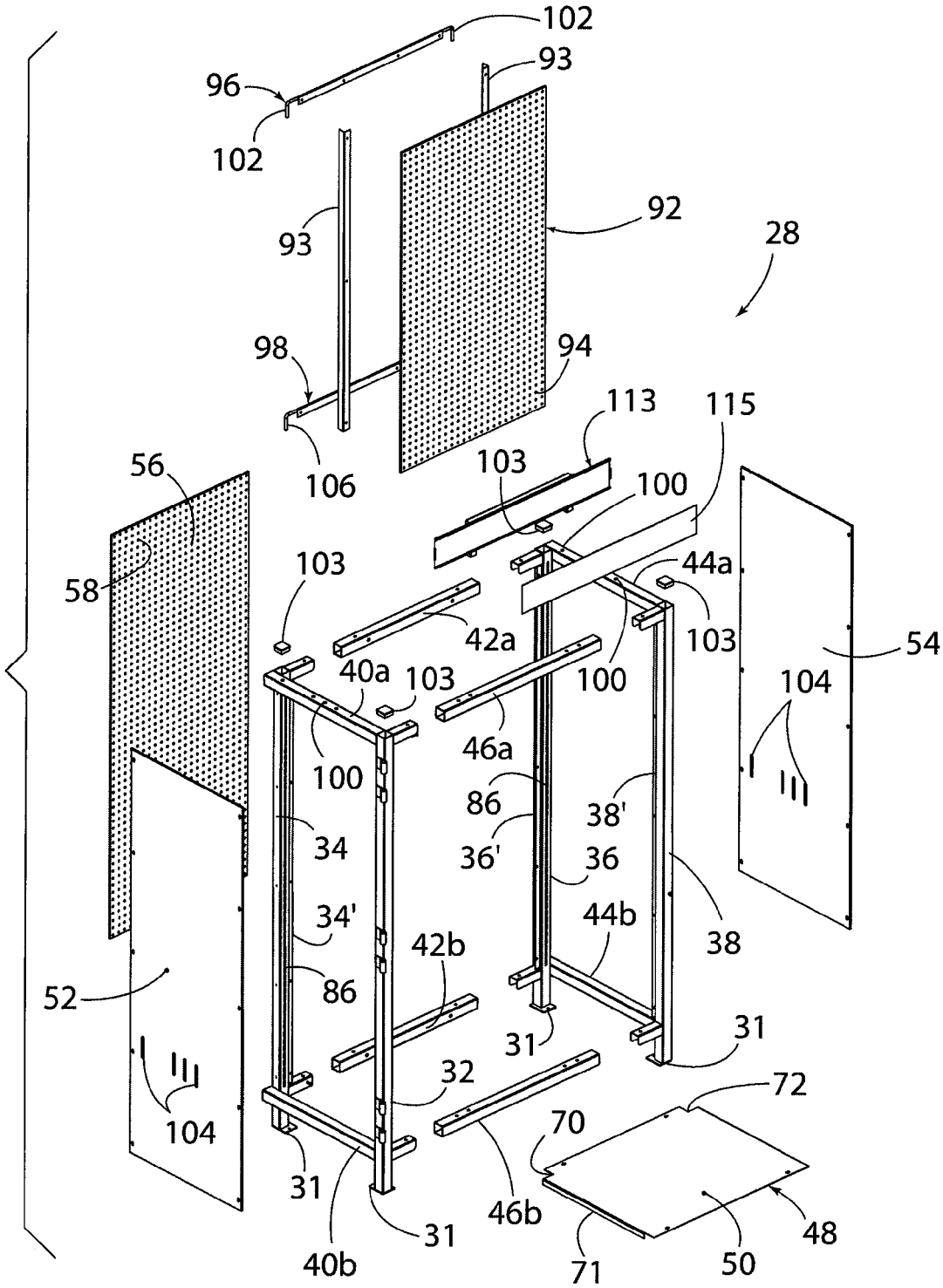
FIG. 10 is an exploded view of a side display section of the merchandiser rack of the present invention.

The illustrated display modules 18 are pivotally connected to the rear storage module 12 to allow the display modules 18 to be rotated relative to the rear storage module 12 between an open position (see FIGS. 1-6) and a closed position (see FIGS. 7-9). The display modules 18 comprise a first/right side display module 130 and a second/left side display module 132. The first/right side display module 130 is pivotally connected to the right side display section 28 and the second/left side display module 132 is connected to the left side display section 30. The first/right side display module 130 and the second/left side display module 132 can be identical or can have different configurations (as is illustrated in the drawings).

In the illustrated embodiment, the first/right side display module 130 (FIGS. 1-9 and 12) comprises a left side support assembly 134, a right side support assembly 135, a top front inverted U-shaped connector bar 136, a top rear inverted U-shaped connector bar 137, a bottom front connector bar 140, a bottom rear connector bar 141, a side display component 138, and a side frame member 139. The left side support assembly 134, the right side support assembly 135, the top front inverted U-shaped connector bar 136, the top rear inverted U-shaped connector bar 137, the bottom front connector bar 140 and the bottom rear connector bar 141 form a structure for supporting the at least one display shelf 24 of the first/right side display module 130.

The illustrated left side support assembly 134 supports a left side of the display shelves 24. The left side support assembly 134 comprises a rectangular base 142, a front upright 143, a rear upright 144, a top cross-bar 145, a pair of shelf support rods 146 and a pair of swivel casters 148. The rectangular base 142 includes a front shaft 200, a right side shaft 202, a rear shaft 204 and a left side shaft 206. The rectangular base 142 also includes a front caster support plate 208 at a front end thereof and a rear caster support plate 210 at a rear end thereof. One of the swivel casters 148 is connected to each of the front caster support plate 208 and the rear caster support plate 210 to allow the left side support assembly 134, and thereby the first/right side display module 130 to roll on the floor as discussed in more detail below. The front upright 143 and the rear upright 144 are connected to a top of the left side shaft 206 of the rectangular base 142 and extend upwardly therefrom. The top cross-bar 145 is connected to and extends between the tops of the front upright 143 and the rear upright 144. The pair of shelf support rods 146 are connected to and extend between the top of the left side shaft 206 of the rectangular base 142 and a bottom of the top cross-bar 145. The shelf support rods 146 can be vertically orientated or angled rearward from a bottom to a top thereof (as illustrated) to allow the display shelves 24 to be staggered as discussed in more detail below. The left side support assembly 134 can include a handle 212 connected to the front upright 143 for easily moving the left side support assembly 134 and a locking mechanism 214 for interacting with the second/left side display module 132 to lock the rear storage module 12 in the closed position as discussed in more detail below.

In the illustrated example, the illustrated right side support assembly 135 supports a right side of the display shelves 24. The right side support assembly 135 can be substantially identical to the left side support assembly 134, except for the handle 212 and the locking mechanism 214. The right side support assembly 135 can therefore comprise a rectangular base 142', a front upright (not shown), a rear upright 144', a top cross-bar 145', a pair of shelf support rods 146' and a pair of swivel casters 148'. The rectangular base 142' includes a front shaft 200', a right side shaft 202', a rear shaft 204' and a left side shaft 206'. The rectangular base 142' also includes a front caster support plate 208' at a front end thereof and a rear caster support plate 210' at a rear end thereof. One of the swivel casters 148' is connected to each of the front caster support plate 208' and the rear caster support plate 210' to allow the right side support assembly 135, and thereby the first/right side display module 130 to roll on the floor as discussed in more detail below. The front upright and the rear upright 144' are connected to a top of the left side shaft 206' of the rectangular base 142' and extend upwardly therefrom. The top cross-bar 145' is connected to and extends between the tops of the front upright and the rear upright 144'. The pair of shelf support rods 146' are connected to and extend between the top of the left side shaft 206' of the rectangular base 142' and a bottom of the top cross-bar 145'. The shelf support rods 146' can be vertically orientated or angled rearward from a bottom to a top thereof (as illustrated) to allow the display shelves 24 to be staggered as discussed in more detail below.

The illustrated top front inverted U-shaped connector bar 136, the top rear inverted U-shaped connector bar 137, the bottom front connector bar 140 and the bottom rear connector bar 141 connect the left side support assembly 134 to the right side support assembly 135 to form a structure for supporting the at least one display shelf 24 of the first/right side display module 130. The top front inverted U-shaped connector bar 136 includes a top horizontal shaft 216, a left vertical shaft 218 and a right vertical shaft 220. The left vertical shaft 218 is connected to the left side support assembly 134 by being inserted into a top of the front upright 143 and the right vertical shaft 220 is connected to the right side support assembly 135 by being inserted into a top of the front upright. The top rear inverted U-shaped connector bar 137 includes a top horizontal shaft 216', a left vertical shaft 218' and a right vertical shaft 220'. The left vertical shaft 218' is connected to the left side support assembly 134 by being inserted into a top of the rear upright 144 and the right vertical shaft 220' is connected to the right side support assembly 135 by being inserted into a top of the rear upright 144'. The bottom front connector bar 140 is inserted into and connected to the front shaft 200 of the rectangular base 142 of the left side support assembly 134 and the front shaft 200' of the rectangular base 142' of the right side support assembly 135. The bottom rear connector bar 141 is inserted into and connected to the rear shaft 204 of the rectangular base 142 of the left side support assembly 134 and the rear shaft 204' of the rectangular base 142' of the right side support assembly 135. Accordingly, the left side support assembly 134, the right side support assembly 135, the top front inverted U-shaped connector bar 136, the top rear inverted U-shaped connector bar 137, the bottom front connector bar 140 and the bottom rear connector bar 141 form a structure for supporting the at least one display shelf 24 of the first/right side display module 130.

In the illustrated example, the display shelves 24 can be staggered such that the bottom display shelf 24 is more forward of the display shelf 24 thereabove, with all of the display shelves 24 being a little more rearward than the display shelf 24 below. For example, if the shelf support rods 146 and the shelf support rods 146' are angled rearward from a bottom to a top thereof, the display shelves 24 are staggered such that a bottom display shelf 24 is more forward than the display shelf 24 above the bottom display shelf 24, and so on to the top display shelf 24. The display shelves 24 can include a front panel 165 for accepting advertising or pricing information of the products placed on the display shelves 24 as is well known to those skilled in the art. Furthermore, the display shelves 24 can slope downward from the rear to the front of the display shelves 24 to assist in moving products to the front of the display shelves 24 for easier access to the products on the display shelves 24. Moreover, it is contemplated that the display shelves 24 could include divider walls extending upward from a top surface thereof to form lanes for the products. Furthermore, it is contemplated that any number of display shelves 24 could be used with the first/right side display module 130.

The illustrated side display component 138 of the first/right side display module 130 holds products and displays the products from the right side of the first/right side display module 130. The side display component 138 includes a vertical front panel 164, an angled front panel 166, a top panel 168, a rear panel 170, a divider wall 171 (see FIG. 4), and a side wall and pegboard 172. The vertical front panel 164 and the rear panel 170 extend upward in a substantially parallel orientation from a front and rear of the base 142', respectively. The angled front panel 166 extends upward and rearward from the top of the vertical front panel 164. The top panel 168 extends forwardly from the top of the rear panel 170 and engages the rear of the angled front panel 166, thereby forming an enclosed space. The divider wall 171 is vertically positioned at the intersection of the angled front panel 166 and the top panel 168. The side wall and pegboard 172 is connected to the divider panel 171, the top panel 168, and the rear panel 170. The side wall and pegboard 172 includes a plurality of openings 174 therethrough, thereby forming a substantially rectangular pegboard. The openings 174 in the side wall and pegboard 172 are configured to accept hanger rods (not shown) therein, with the hanger rods accepting products thereon for displaying the products. The hanger rods can accept products thereon for displaying the products as is well known to those skilled in the art.

In the illustrated example, the side frame member 139 of the first/right side display module 130 covers the side display component 138 and connects the first/right side display module 130 to the right side display section 28 of the rear module 12. The side frame member 139 comprises a vertical front bar 176, an angled front bar 178, a top bar 180, a rear bar 182, a bottom bar 184 and a cover 186. The bottom bar 184 is connected to a right side edge of the right side shaft 202' of the rectangular base 142'. The vertical front bar 176 and the rear bar 182 extend upward in a substantially parallel orientation from the top ends of the bottom bar 184. The angled front bar 178 extends upward and rearward from the top of the vertical front bar 176. The top bar 180 extends forwardly from the top of the rear bar 182 and engages the rear of the angled front bar 178, thereby forming an enclosed space. The cover 186 is connected to and covers the vertical front bar 176, the angled front bar 178, the divider wall 171 of the side display component 138 and a front portion of the bottom bar 184. The rear bar 182 includes at least one hinge 188 connected to the front/right side post 32 of the right side display section 28 of the rear module 12, thereby allowing the first/right side display module 130 to rotate relative to the rear module 12.

In the illustrated embodiment, the second/left side display module 132 (FIGS. 1-9 and 13) comprises a right side support assembly 434, a left side support assembly 435, a pair of middle support assemblies 447, a top front connector bar 436, a top rear connector bar 437, a bottom front connector bar 440, a bottom rear connector bar 441, a side display component 438, and a side frame member 439. The right side support assembly 434, the left side support assembly 435, the pair of middle support assemblies 447, the top front connector bar 436, the top rear connector bar 437, the bottom front connector bar 440 and the bottom rear connector bar 441 form a structure for supporting the at least one display shelf 24 of the second/left side display module 132. In the illustrated embodiment, the second/left side display module 132 includes a pair of sets of display shelves 24 comprising a set of left side shelves 24' and a set of right side shelves 24".

The illustrated right side support assembly 434 supports a right side of the right side shelves 24". The right side support assembly 434 comprises a rectangular base 442, a front upright 443, a rear upright 444, a top cross-bar 445, a pair of shelf support rods 446 and a pair of swivel casters 448. The rectangular base 442 includes a front shaft 500, a right side shaft 502, a rear shaft 504 and a left side shaft 506. The rectangular base 442 also includes a front caster support plate 508 at a front end thereof and a rear caster support plate 510 at a rear end thereof. One of the swivel casters 448 is connected to each of the front caster support plate 508 and the rear caster support plate 510 to allow the right side support assembly 434, and thereby the second/left side display module 132 to roll on the floor as discussed in more detail below. The front upright 443 and the rear upright 444 are connected to a top of the right side shaft 502 of the rectangular base 442 and extend upwardly therefrom. The top cross-bar 445 is connected to and extends between the tops of the front upright 443 and the rear upright 444. The pair of shelf support rods 446 are connected to and extend between the top of the left side shaft 506 of the rectangular base 442 and a bottom of the top cross-bar 445. The shelf support rods 446 can be vertically orientated or angled rearward from a bottom to a top thereof (as illustrated) to allow the display shelves 24 to be staggered as discussed in more detail below. The right side support assembly 434 can include a handle 512 connected to the front upright 443 for easily moving the right side support assembly 434.

In the illustrated example, the illustrated left side support assembly 435 forms a left side of the second/left side display module 132. The left side support assembly 435 can be similar to the right side support assembly 434, except for the handle 512. The left side support assembly 435 can therefore comprise a rectangular base 442', a front upright 443', a rear upright 444', a top cross-bar 445', and a pair of swivel casters 448'. The rectangular base 442' includes a front shaft 500', a right side shaft 502', a rear shaft 504' and a left side shaft 506'. The rectangular base 442' also includes a front caster support plate 508' at a front end thereof and a rear caster support plate 510' at a rear end thereof. One of the swivel casters 448' is connected to each of the front caster support plate 508' and the rear caster support plate 510' to allow the right side support assembly 434, and thereby the second/left side display module 132 to roll on the floor as discussed in more detail below. The front upright 443' and the rear upright 444' are connected to a top of the right side shaft 502' of the rectangular base 442' and extend upwardly therefrom. The top cross-bar 445' is connected to and extends between the tops of the front upright 443' and the rear upright 444'.

The illustrated top front connector bar 436, the top rear connector bar 437, the bottom front connector bar 440 and the bottom rear connector bar 441 connect the right side support assembly 434 to the left side support assembly 435, along with the middle support assemblies 447, to form a structure for supporting the at least one display shelf 24 of the second/left side display module 132. The top front connector bar 436 includes a top horizontal shaft 516, a left vertical shaft 518, a right vertical shaft 520 and a pair of middle vertical shafts 521. The left vertical shaft 518 is connected to the right side support assembly 434 by being inserted into a top of the front upright 443 and the right vertical shaft 520 is connected to the left side support assembly 435 by being inserted into a top of the front upright 443'. The pair of middle vertical shafts 521 engage the middle support assemblies 447 as described in more detail below. The top rear connector bar 437 includes a top horizontal shaft 516', a left vertical shaft 518', a right vertical shaft 520' and a pair of middle vertical shafts 521'. The left vertical shaft 518' is connected to the right side support assembly 434 by being inserted into a top of the rear upright 444 and the right vertical shaft 520' is connected to the left side support assembly 435 by being inserted into a top of the rear upright 444'. The pair of middle vertical shafts 521' engage the middle support assemblies 447 as described in more detail below. The bottom front connector bar 440 is inserted into and connected to the front shaft 500 of the rectangular base 442 of the right side support assembly 434 and the front shaft 500' of the rectangular base 442' of the left side support assembly 435. The bottom rear connector bar 441 is inserted into and connected to the rear shaft 504 of the rectangular base 442 of the right side support assembly 434 and the rear shaft 504' of the rectangular base 442' of the left side support assembly 435. Accordingly, the right side support assembly 434, the left side support assembly 435, the top front connector bar 436, the top rear connector bar 437, the bottom front connector bar 440 and the bottom rear connector bar 441 form a structure for supporting the at least one display shelf 24 of the second/left side display module 132.

The middle support assemblies 447 of the illustrated embodiment interact with the right side support assembly 434 and each other to support the pair of sets of display shelves 24 comprising the set of left side shelves 24' and the set of right side shelves 24". In the illustrated example, the pair of middle support assemblies 447 are substantially identical, although it is contemplated that they have different configurations. Each middle support assembly 447 comprises a bottom shaft 450, a front upright 452, a rear upright 454, a top cross-bar 456 and a pair of shelf support rods 458. The front upright 452 and the rear upright 444 are connected to a top of the bottom shaft 450 and extend upwardly therefrom. The top cross-bar 456 is connected to and extends between the tops of the front upright 452 and the rear upright 454. The pair of shelf support rods 458 are connected to and extend between the top of the bottom shaft 450 and a bottom of the top cross-bar 456. The shelf support rods 458 can be vertically orientated or angled rearward from a bottom to a top thereof (as illustrated) to allow the display shelves 24 to be staggered as discussed in more detail below.

Figure 13:
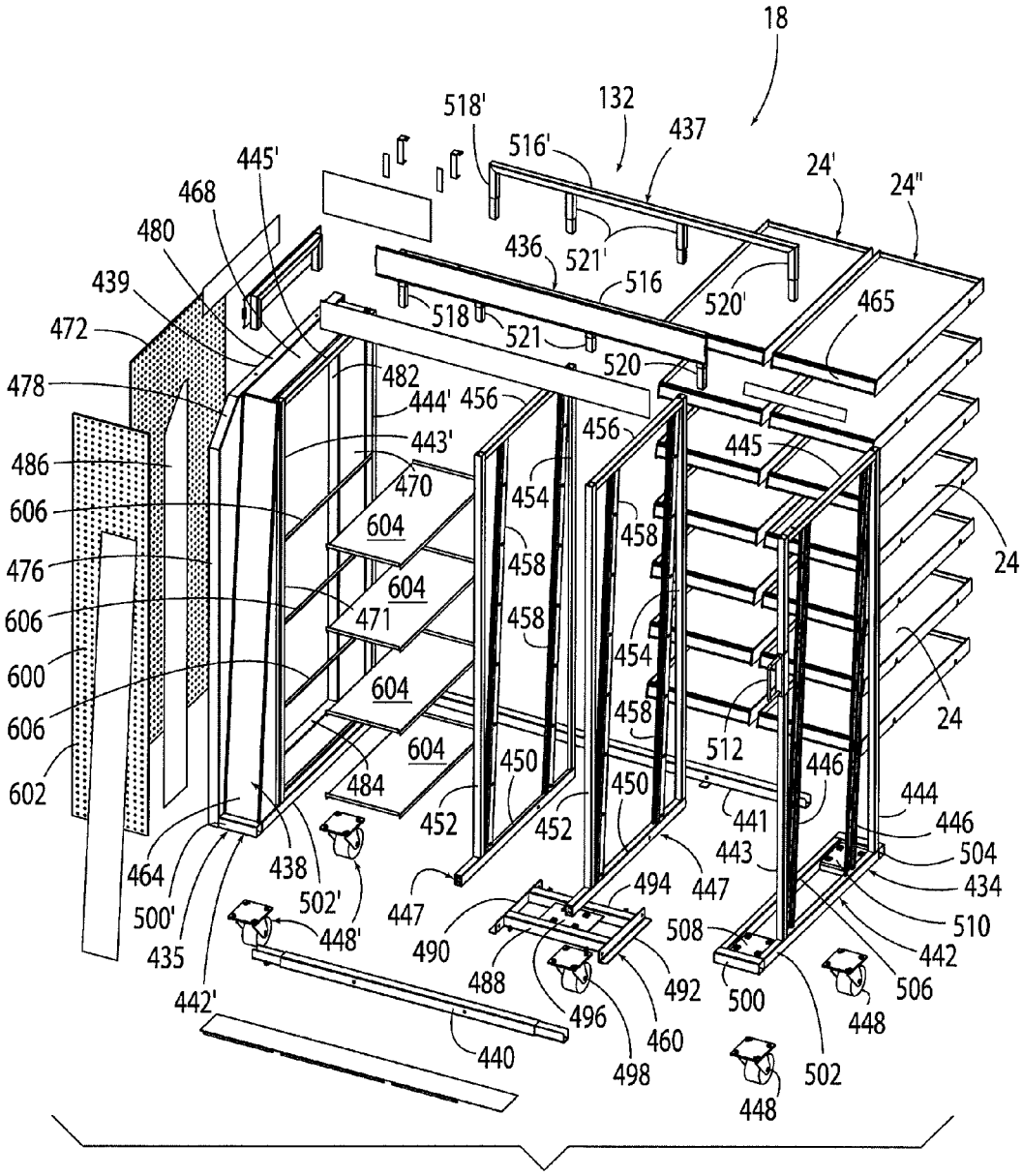
FIG. 13 is an exploded view of a left side display module of the merchandiser rack of the present invention.

In the illustrated example, the middle support assemblies 447 are substantially equidistant from each other and a rightmost one of the middle support assemblies 447 has substantially the same distance from the right side support assembly 434 as the distance between the two middle support assemblies 447. The bottom shafts 450 of each of the middle support assemblies 447 extend between and are connected to the bottom front connector bar 440 and the bottom rear connector bar 441. Furthermore, the front uprights 452 accept the pair of middle shafts 521 of the top front connector bar 436 therein and the rear uprights 454 accept the pair of middle shafts 521' of the front rear connector bar 437 therein. As illustrated in FIG. 13, the set of left side shelves 24' extend between the middle support assemblies 447 and are connected to the shelf support rods 458 of the middle support assemblies 447. The set of right side shelves 24" extend between the rightmost one of the middle support assemblies 447 and the right side support assembly 434 and are connected to the shelf support rods 458 of the rightmost one of the middle support assemblies 447 and the shelf support rods 446 of the right side support assembly 434.

The illustrated display shelves 24 can be staggered such that the bottom display shelf 24 is more forward of the display shelf 24 thereabove, with all of the display shelves 24 being a little more rearward than the display shelf 24 below. For example, if the shelf support rods 446 and the shelf support rods 458 are angled rearward from a bottom to a top thereof, the display shelves 24 are staggered such that a bottom display shelf 24 is more forward than the display shelf 24 above the bottom display shelf 24, and so on to the top display shelf 24. The display shelves 24 can include a front panel 465 for accepting advertising or pricing information of the products placed on the display shelves 24 as is well known to those skilled in the art. Furthermore, the display shelves 24 can slope downward from the rear to the front of the display shelves 24 to assist in moving products to the front of the display shelves 24 for easier access to the products on the display shelves 24. Moreover, it is contemplated that the display shelves 24 could include divider walls extending upward from a top surface thereof to form lanes for the products. Furthermore, it is contemplated that any number of display shelves 24 could be used with the second/left side display module 132.

In the illustrated example, the middle support assemblies 447 include a middle support assembly base 460 for supporting the middle support assemblies 447 and for assisting in movement of the second/left side display module 132. The middle support assembly base 460 comprises a front bar 488, a left side bar 490, a right side bar 492 and a rear bar 494, with the front bar 488, the left side bar 490, the right side bar 492 and the rear bar 494 forming a rectangle. The left side bar 490 is connected to the bottom shaft 450 of the leftmost one of the middle support assemblies 447 and the right side bar 492 is connected to the bottom shaft 450 of the rightmost one of the middle support assemblies 447. A caster support plate 496 extends between the front bar 488 and the rear bar 494 and is connected thereto. A swivel caster 498 is connected to the caster support plate 496 to allow the second/left side display module 132 to roll on the floor as discussed in more detail below.

The illustrated side display component 438 of the second/left side display module 132 holds products and displays the products from the left side of the second/left side display module 132. The side display component 438 includes an angled front panel 464, a top panel 468, a rear panel 470, a divider wall 471, and a side wall and pegboard 472. The front panel 464 and the rear panel 470 extend upward from a front and rear of the base 442', respectively. The top panel 468 extends between top of the rear panel 470 and the front panel 464, thereby forming an enclosed space. The divider wall 471 is vertically positioned at the intersection of the angled front panel 464 and the top panel 468. The side wall and pegboard 472 is connected to the divider wall 471, the top panel 468, and the rear panel 470. The side wall and pegboard 472 includes a plurality of openings 474 therethrough, thereby forming a substantially rectangular pegboard. The openings 474 in the side wall and pegboard 472 are configured to accept hanger rods (not shown) therein, with the hanger rods accepting products thereon for displaying the products. The hanger rods can accept products thereon for displaying the products as is well known to those skilled in the art.

In the illustrated example, the side frame member 439 of the second/left side display module 132 covers the side display component 438 and connects the second/left side display module 132 to the right side display section 28 of the rear module 12. The side frame member 439 comprises a vertical front bar 476, an angled front bar 478, a top bar 480, a rear bar 482, a bottom bar 484 and a cover 486. The bottom bar 484 is connected to a left side edge of the left side shaft 506' of the rectangular base 442'. The vertical front bar 476 and the rear bar 482 extend upward in a substantially parallel orientation from the top ends of the bottom bar 484. The angled front bar 478 extends upward and rearward from the top of the vertical front bar 476. The top bar 480 extends forwardly from the top of the rear bar 482 and engages the rear of the angled front bar 478, thereby forming an enclosed space. The cover 486 is connected to and covers the vertical front bar 476, the angled front bar 478, the divider wall 471 of the side display component 438 and a front portion of the bottom bar 484. The rear bar 482 includes at least one hinge 489 connected to the front/left side post 34 of the left side display section 30 of the rear module 12, thereby allowing the second/left side display module 132 to rotate relative to the rear module 12.

In the illustrated embodiment, the area between the leftmost one of the middle support assemblies 447 and the left side support assembly 435 can be used for storage and display of products. For example, a front peg board 600 having openings 602 therein can extend between insides of the front upright 443' of the side display component 438 and the front upright 452 of the leftmost one of the middle support assemblies 447. The openings 602 in the front pegboard 600 are configured to accept hanger rods (not shown) therein. The hanger rods can accept products thereon for displaying the products as is well known to those skilled in the art. Furthermore, the area could include a plurality of storage shelves 604 located behind the front pegboard 600. The storage shelves 604 can be connected to the front upright 452 and the rear upright 454 of the leftmost one of the middle support assemblies 447 on one side and to rods 606 extending between the front upright 443' and the rear upright 444' of the left side support assembly 435 on the other side. The storage shelves 604 are not accessible from an outside of the merchandiser rack 10 when the display modules 18 are in the closed position, but are accessible when the display modules are in the open position (see FIG. 7).

In the illustrated merchandiser rack 10, the merchandise placed on the display shelves 24 can be displayed in the front of the merchandiser rack 10 and the merchandise can easily be stocked onto the display shelves 24 by moving the merchandiser rack 10 to the open configuration and placing the stock on the display shelves 24 such that they are moved into a displayed position at the front of the display shelves 24 by gravity. The merchandiser rack 10 is moved to the open position by rotating the display modules 18 about the rear storage module 12. For example, in the illustrated embodiment, the merchandiser rack 10 is moved to the open position by rotating first/right side display module 130 and the second/left side display module 132 about the right side display section 28 and the left side display section 30 of the rear storage module 12, respectively. Since the first/right side display module 130 is supported by the swivel casters 148, 148' and the second/left side display module 132 is supported by the swivel casters 448, 448' and 498, the first/right side display module 130 and the second/left side display module 132 can easily move about the pivots 188 and 498, respectively. Furthermore, the first/right side display module 130 and the second/left side display module 132 can easily be moved by pulling on the handles 212 and 512, respectively. During movement of the first/right side display module 130 and the second/left side display module 132, the rear storage module 12 remains stationary.

The illustrated display shelves 24 can therefore be easily stocked by placing merchandise onto the display shelves from the rear 22 when the merchandiser rack 10 is in the open position. Therefore, the merchandise will always be positioned on the front of the display shelves 24 for easy accessibility and display. Likewise, by placing the stock on the rear of the display shelves 24, the older stock will be taken from the merchandiser rack 10 and purchased by the consumer. Accordingly, the merchandiser rack 10 can provide that the stock placed on the display shelves 24 first is the first stock purchased (i.e., first in, first out). However, it is contemplated that the shelves could be stocked from the front by pushing the stock currently on the display shelves 24 backward and inserting new stock in the front area of the shelves.

Figure 14:
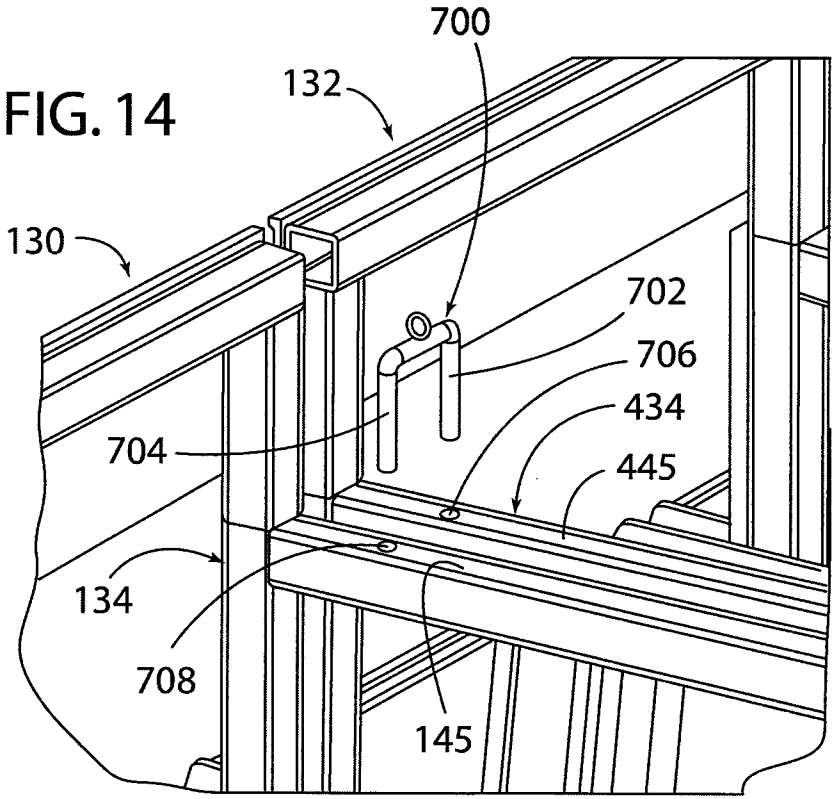
FIG. 14 is a partial perspective view of the merchandiser rack of the present invention showing a locking mechanism.

In the illustrated example, it is contemplated that the merchandiser rack 10 could include a locking mechanism 700 (FIG. 14) for locking the merchandiser rack 10 in the closed position. The locking mechanism 700 can comprise an inverted U-shaped member having a first leg 702 and a second leg 704. The first leg 702 of the locking mechanism 700 can be inserted into an opening 706 in the top of the top-cross bar 445 of the right side support assembly 434 of the second/left side display module 132 and the second leg 704 of the locking mechanism 700 can be inserted into an opening 708 in the top of the top cross-bar 145 of the left side support assembly 134 of the first-right side display module 130. Therefore, the locking mechanism 700 would prevent the first/right side display module 130 and the second/left side display module 132 from rotating about the right side display section 28 and the left side display section 30 of the of the rear storage module 12, respectively. However, it is contemplated that any locking mechanism that prevents the first/right side display module 130 and the second/left side display module 132 from rotating about the right side display section 28 and the left side display section 30 of the of the rear storage module 12, respectively, could be used (e.g., a rotating latch and mating pin, a padlock, etc.) or that no locking mechanism 700 be used.

The foregoing detailed description is considered that of a preferred embodiment only, and the particular shape and nature of at least some of the components in this embodiment are at least partially based on manufacturing advantages and considerations as well as on those pertaining to assembly and operation. Modifications of this embodiment may well occur to those skilled in the art and to those who make or use the invention after learning the nature of this preferred embodiment, and the invention lends itself advantageously to such modification and alternative embodiments. For example, all of the elements of the display modules can have any cross-sectional shape and can be made of any material (e.g., wood, metal, plastic, etc.). Moreover, while three left plate pivots 188 and 498 are shown, the display modules 18 can be pivotally connected to the rear storage module 12 using any number of pivots or in any manner. It is further contemplated that the display modules 18 could be disconnected from the rear storage module 12 to provide access to the rear of the display modules 18. Furthermore, the illustrated merchandiser rack 10 could also include advertising displays 800 attached to the merchandiser rack at several points (see FIG. 1). Moreover, it is contemplated that the rear storage module could be free and movable on a floor or fixed to a structure of a building (e.g., shelves in a store). It is also contemplated that the display modules could move on rails or could slide. It is also contemplated that the rear display module could include soft bumpers 900 (see FIG. 7) on a front thereof for engaging with the display modules when the merchandiser rack 10 is in the closed position). Therefore, it is to be understood that the embodiment shown in the drawings and described above is provided principally for illustrative purposes and should not be used to limit the scope of the invention As will be seen and appreciated by those skilled in the art, the present invention contemplates the following major points of achievement, as well as others inherent in the disclosure.

We claim:

1. A merchandiser rack comprising:

A rear storage module having a front face, a center storage area including at least one shelf for storing products and a plurality of support posts configured to secure the rear storage module in a predetermined position, wherein the center storage area has an open front and an open back, the rear storage module further including first and second opposing side display sections connected to opposite sides of the center storage area, each of the first and second opposing side display sections include at least one shelf that extends orthogonal to the at least one shelf of the center storage area;

wherein each of the first and second opposing side display sections include an outer board and a central board, each outer board located on opposing sides of the center storage are to separate the respective first and second opposing side display sections from the center storage area, wherein the at least one shelf of the center storage area has corresponding mounting rods that fit within respective holes of each of the outer boards of the first and second opposing side displays to mount the at least one shelf of the central storage area between the opposing first and second side display sections;

wherein each central board of the first and second side display sections divides the corresponding side display sections into two separate columns to organize items stored within each of the side display sections;

and at least two display modules, the display modules each having a front and a rear;

the at least two display modules each having shelves, with at least a portion of the rear of each of the at least two display modules being open to allow stocking of the shelves from the rear, the shelves also being accessible from the front of each of the at least two display modules;

wherein the display modules are pivotally connected to opposing edges of the front face of the rear storage module to allow the display modules to be rotated relative to the rear storage module between an open position and a closed position;

wherein the open position allows access to the rear of the shelves of each of the at least two display modules to allow the open portion of the rear of each of the at least two display modules to be stocked from the rear;

and wherein the shelves of each of the at least two display modules are not accessible through the rear of the respective display modules when the merchandiser rack is in the closed position, and wherein the shelves of the at least two display modules are generally accessible through the front of the at least two display modules when the merchandiser rack is in the closed position, and the rear of each of the at least two display modules is parallel to the rear storage module, and wherein each of the display modules abut only the front face of the rear storage module when in the closed position.

2. The merchandiser rack of claim 1, further including:

a locking mechanism for locking the merchandiser rack in the closed position.

3. The merchandiser rack of claim 1, wherein:

at least one of the display modules includes a storage section that is only accessible when the merchandiser rack is in the open position.

4. The merchandiser rack of claim 1, wherein:

at least one of the display modules includes two columns of shelves.

5. The merchandiser rack of claim 1, wherein:

each display modules include casters for moving the display modules relative to the rear storage module and the plurality of supporting posts of the rear storage module each include a supporting plate.

6. The merchandiser rack of claim 1, wherein:

the rear storage module has a front first side corner and a front second side corner;

a first one of the display modules is pivotally connected with the front first side corner of the rear storage module;

a second one of the display modules is pivotally connected with the front second side corner of the rear storage module.

7. The merchandiser rack of claim 1, wherein:

the at least two display modules consists of only two display modules.

8. The merchandiser rack of claim 1, wherein:

at least one of the shelves of the respective display modules is located on a side of the respective display module for displaying merchandise on a side of the merchandiser rack.

9. A merchandiser rack comprising:

a substantially rectangular rear storage module having a storage front, a storage rear, an open side, and a central storage area including at least one shelf for storing products, the rear storage module having at least one side display section and a partition board wall positioned within the at least one side display section at a central location, the board wall having openings for accepting rods for hanging merchandise; wherein the partition at least partially defines an open storage space of the at least one side display section accessible through the open side of the rear storage module so that items made be stored and accessed through the open side of the rear storage module, the rear storage module having a front first side corner and a front second side corner and a plurality of supporting posts configured to secure the rear storage module in a predetermined position; and two substantially rectangular display modules, each of the display modules having a display front and a stocking rear;

the display modules each having shelves, with at least a portion of the rear of the display modules being open to allow stocking of the shelves from the stocking rear, the shelves also being accessible from the display front of the display modules;

a first one of the rectangular display modules being pivotally connected with the front first side corner of the rear storage module;

a second one of the rectangular display modules being pivotally connected with the front second side corner of the rear storage module;

wherein the display modules are pivotally connected to the rear storage module to allow the display modules to be rotated relative to the rear storage module between an open position wherein the stocking rear of the display modules are accessible and a closed position wherein the stocking rear of the display modules abut only the storage front of the rear storage module;

wherein the open position allows access to the stocking rear of the display modules to allow the display modules to be stocked from the stocking rear; and wherein when in the closed position, the shelves of the display modules are not accessible through the stocking rear of the display modules, but the shelves of the display module are accessible from the display front of the display modules.

10. The merchandiser rack of claim 9, wherein:

the rear storage module comprises a pair of side display sections connected to opposite sides of the central storage area, with the side display sections having an area for displaying and storage of merchandise.

11. The merchandiser rack of claim 9, further including:

a locking mechanism for locking the merchandiser rack in the closed position.

12. The merchandiser rack of claim 9, wherein:

the at least one display module includes a storage section that is only accessible when the merchandiser rack is in the open position.

13. The merchandiser rack of claim 9, wherein:

the at least one display module includes two columns of shelves.

14. The merchandiser rack of claim 9, wherein:

the display modules include casters for moving the display modules relative to the rear storage module, and wherein each of the plurality of supporting posts of the rear storage module includes a supporting plate.

15. The merchandiser rack of claim 9, wherein:

the at least one display module of the rear storage module includes shelving for displaying merchandise on the open side of the rear storage module.

16. A method of supplying a merchandiser rack comprising: providing a rear storage module having a front, a rear, an open side, a center storage area including at least one shelf for storing products, the rear storage module having at least one side display section and a partition board wall positioned within the at least one side display section at a central location, the board wall having openings for accepting rods for hanging merchandise; wherein the partition at least partially defining an open storage space within the rear storage module, the open storage space being accessible through a side of the rear storage module so that items made be stored and accessed through the open side of the rear storage module;

pivotally connecting at least two display modules to the rear storage module at first and second front side corners of the rear storage module, respectively, the display modules each having a front, a rear and shelves, with at least a portion of the rear of the display modules being open, the shelves also being accessible from the front of the display modules;

rotating the display modules relative to the rear storage module from a closed position to an open position and stocking the shelves of the display modules from the rear; and rotating the display modules relative to the rear storage module back to the closed position, wherein the display modules abut a front face of the rear storage module;

wherein when in the closed position, the shelves of the display modules are not accessible through the rear of the display modules, but the shelves of the display modules are accessible from the display front of the display modules.

* * * * *